US008541673B2

(12) United States Patent
Jones et al.

(10) Patent No.: US 8,541,673 B2
(45) Date of Patent: Sep. 24, 2013

(54) HAMMER STOPPERS FOR PIANOS HAVING ACOUSTIC AND SILENT MODES

(75) Inventors: Scott Jones, Boalsburg, PA (US); James M. Lombino, Ashfield, MA (US); Susan Yake Kenagy, Dix Hills, NY (US); Sue Guan Lim, Flushing, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 0 days.

(21) Appl. No.: 13/437,419

(22) Filed: Apr. 2, 2012

(65) Prior Publication Data

US 2012/0240743 A1 Sep. 27, 2012

Related U.S. Application Data

(63) Continuation-in-part of application No. 12/429,485, filed on Apr. 24, 2009, now Pat. No. 8,148,620.

(51) Int. Cl.
*G10C 3/18* (2006.01)

(52) U.S. Cl.
USPC ..... 84/243; 84/239; 84/240

(58) Field of Classification Search
USPC ..... 84/243, 239
See application file for complete search history.

(56) References Cited

U.S. PATENT DOCUMENTS

| | | | | |
|---|---|---|---|---|
| 527,533 | A | 10/1894 | McChesney et al. | |
| 533,661 | A * | 2/1895 | McChesney et al. | 84/224 |
| 782,799 | A | 2/1905 | Smith | |
| 3,545,329 | A | 12/1970 | Roehrig | |
| 3,559,526 | A | 2/1971 | Raffali | |
| 4,061,067 | A | 12/1977 | Carbone | |
| 4,194,428 | A | 3/1980 | McFarlin | |
| 4,203,341 | A | 5/1980 | Takahashi | |
| 4,450,747 | A | 5/1984 | Aoyama | |

(Continued)

FOREIGN PATENT DOCUMENTS

| | | |
|---|---|---|
| DE | 44 08 505 | 9/1995 |
| DE | 195 27 270 | 1/1997 |

(Continued)

OTHER PUBLICATIONS

European International Search Report and Written Opinion dated Oct. 13, 2008 in connection with International Application No. PCT/US2008.070045, 19 pages.

(Continued)

*Primary Examiner* — David Warren
*Assistant Examiner* — Robert W Horn
(74) *Attorney, Agent, or Firm* — Fish & Richardson P.C.

(57) ABSTRACT

A piano hammer stopper system includes a stopper rail set comprising at least first and second stopper rail members, each movable between respective first positions allowing unobstructed movement of associated piano hammers and respective second positions stopping at least one associated piano hammer from striking any corresponding string. At least one drive shaft is rotatably coupled to one or both of the stopper rail members. A drive arm is attached to the drive shaft and engages a drive fulcrum. A travel guide directs movement of the first and second stopper rail members between respective first and second positions. Rotation of the drive shaft rotates the drive arm to engage the drive fulcrum for moving one or both of the first and second stopper rail members between respective first and second positions.

40 Claims, 20 Drawing Sheets

(56) References Cited

U.S. PATENT DOCUMENTS 4,679,477 A 7/1987 Monte
4,760,768 A 8/1988 Yamamoto
4,860,626 A 8/1989 Tanaka et al.
4,879,939 A 11/1989 Wall
4,901,614 A 2/1990 Kumano et al.
5,107,748 A 4/1992 Muramatsu et al.
5,125,309 A 6/1992 Stanwood
5,192,820 A 3/1993 Kawamura et al.
5,194,685 A 3/1993 Kawamura et al.
5,196,638 A 3/1993 Hayashida et al.
5,210,367 A 5/1993 Taguchi et al.
5,235,892 A 8/1993 Terada et al.
5,239,907 A 8/1993 Sugiyama et al.
5,272,950 A 12/1993 Petersen
5,286,915 A 2/1994 Komano et al.
5,353,671 A 10/1994 Inoue et al.
5,374,775 A 12/1994 Kawamura et al.
5,386,083 A 1/1995 Kawamura
5,410,937 A 5/1995 Okamato et al.
5,428,186 A 6/1995 Kaneko et al.
5,434,349 A * 7/1995 Kawamura ..... 84/719
5,444,181 A 8/1995 Wada et al.
5,451,706 A 9/1995 Yamamoto et al.
5,463,184 A * 10/1995 Kawamura ..... 84/719
5,483,861 A 1/1996 Kawamura et al.
5,506,369 A 4/1996 Kawamura et al.
5,509,340 A 4/1996 Kawamura
5,524,519 A 6/1996 Matsunaga et al.
5,528,969 A 6/1996 Kihara et al.
5,530,198 A 6/1996 Ishii
5,539,142 A 7/1996 Emerson et al.
5,541,353 A 7/1996 Kawamura et al.
5,542,328 A 8/1996 Pimentel
5,545,839 A 8/1996 Kawamura et al.
5,552,559 A * 9/1996 Sugiyama et al. ..... 84/171
5,552,560 A 9/1996 Ura
5,552,561 A 9/1996 Nakada et al.
5,557,052 A 9/1996 Hayashida et al.
5,565,636 A * 10/1996 Sugiyama ..... 84/171
5,567,902 A 10/1996 Kimble et al.
5,571,982 A 11/1996 Masubuchi
5,574,241 A 11/1996 Kumano et al.
5,583,306 A 12/1996 Hayashida et al.
5,583,310 A 12/1996 Sugiyama et al.
5,591,927 A 1/1997 Kawamura et al.
5,594,188 A 1/1997 Kawamura et al.
5,600,077 A 2/1997 Honda
5,602,351 A 2/1997 Kawamura et al.
5,608,175 A 3/1997 Kawamura
5,610,356 A 3/1997 Koseki et al.
5,612,502 A 3/1997 Ura
5,616,880 A 4/1997 Hayashida et al.
5,641,930 A 6/1997 Nakada et al.
5,646,359 A 7/1997 Kihara et al.
5,648,621 A 7/1997 Sasaki
5,652,399 A 7/1997 Fujiwara et al.
5,652,403 A 7/1997 Sugiyama et al.
5,663,513 A 9/1997 Sugiyama et al.
5,741,995 A * 4/1998 Kawamura et al. ..... 84/721
5,796,023 A 8/1998 Kumano et al.
5,804,816 A 9/1998 Yamamoto et al.
5,811,702 A 9/1998 Tomizawa et al.
5,821,443 A 10/1998 Masubushi
5,824,928 A 10/1998 Kumano et al.
5,824,930 A 10/1998 Ura et al.
5,834,668 A 11/1998 Kumano et al.
5,837,911 A 11/1998 Inoue
5,844,154 A * 12/1998 Kimble ..... 84/171
5,861,566 A 1/1999 Kaneko et al.
5,874,687 A 2/1999 Kawamura
5,880,389 A 3/1999 Muramatsu
5,880,393 A 3/1999 Kaneko et al.
5,895,875 A 4/1999 Osuga et al.
5,909,028 A 6/1999 Yamamoto
5,925,844 A 7/1999 Inaba
5,932,825 A 8/1999 Kumano et al.
5,942,702 A 8/1999 Inoue
5,942,705 A 8/1999 Kumano et al.
5,945,613 A 8/1999 Kimble
5,949,013 A 9/1999 Satoshi
5,977,466 A 11/1999 Muramatsu
5,994,632 A 11/1999 Muramatsu et al.
6,005,178 A 12/1999 Osuga et al.
6,011,214 A * 1/2000 Kawamura ..... 84/719
6,075,213 A 6/2000 Ichiro
6,084,167 A 7/2000 Akimoto et al.
6,147,289 A 11/2000 Kumano
6,194,649 B1 2/2001 Itou et al.
6,199,649 B1 3/2001 Alanko
6,229,081 B1 5/2001 Ura et al.
6,245,985 B1 6/2001 Sasaki et al.
6,265,647 B1 7/2001 Tamaki et al.
6,271,447 B1 8/2001 Fujiwara et al.
6,281,422 B1 8/2001 Kawamura
6,288,313 B1 9/2001 Sato et al.
6,297,437 B1 10/2001 Ura et al.
6,359,207 B1 3/2002 Oba et al.
6,362,412 B1 3/2002 Ura
6,365,820 B1 4/2002 Kondo et al.
6,376,759 B1 4/2002 Suzuki
6,380,469 B2 4/2002 Uehara
6,380,470 B1 4/2002 Fujiwara et al.
6,380,472 B1 4/2002 Sugiyama et al.
6,380,473 B2 4/2002 Uehara
6,392,132 B2 5/2002 Uehara
6,407,321 B2 6/2002 Tamaki et al.
6,407,326 B1 6/2002 Kondo
6,417,439 B2 7/2002 Uehara et al.
6,417,440 B2 7/2002 Furuki
6,420,642 B1 7/2002 Muramatsu et al.
6,423,889 B2 7/2002 Inoue
6,448,481 B2 9/2002 Maehara et al.
6,452,079 B2 * 9/2002 Sugiyama et al. ..... 84/423 R
6,476,304 B2 11/2002 Uehara
6,515,213 B2 2/2003 Muramatsu et al.
6,528,713 B2 3/2003 Maehara
6,552,251 B2 4/2003 Muramatsu et al.
6,600,097 B2 7/2003 Shiiya
6,649,821 B2 11/2003 Inoue
6,660,917 B2 12/2003 Goto et al.
6,670,532 B2 12/2003 Maehara
6,683,242 B2 1/2004 Inoue et al.
6,713,751 B2 3/2004 Muramatsu et al.
6,730,839 B2 * 5/2004 Itou ..... 84/719
6,737,571 B2 5/2004 Furukawa
6,765,142 B2 7/2004 Sakurada et al.
6,815,603 B2 11/2004 Kato et al.
6,864,412 B2 3/2005 Ichikawa
6,867,359 B2 3/2005 Koseki et al.
6,870,151 B2 3/2005 Kato
6,933,435 B2 8/2005 Kato et al.
6,933,494 B2 8/2005 Kato et al.
6,940,005 B2 9/2005 Muramatsu et al.
6,965,070 B2 11/2005 Wenjun
6,969,791 B2 11/2005 Fujiwara
6,992,241 B2 1/2006 Fujiwara
6,992,242 B2 1/2006 Shirayanagi et al.
6,995,308 B2 2/2006 Nishida et al.
7,005,570 B2 2/2006 Nishitani
7,009,095 B2 3/2006 Ichikawa et al.
7,012,178 B2 3/2006 Muramatsu
7,044,655 B2 5/2006 Kato et al.
7,049,576 B2 5/2006 Kato et al.
7,057,101 B2 6/2006 Ishida
7,094,961 B2 8/2006 Ura et al.
7,121,737 B2 10/2006 Kato et al.
7,132,643 B2 11/2006 Kato
7,161,137 B2 1/2007 Ura et al.
7,176,370 B2 2/2007 Osuga et al.
7,179,974 B2 2/2007 Muramatsu
7,186,967 B2 3/2007 Kato
7,217,877 B2 5/2007 Funaki
7,238,868 B2 7/2007 Muramatsu et al.
7,259,313 B2 8/2007 Suzuki et al.

| | | | | |
|---|---|---|---|---|
| 7,265,281 | B2 | 9/2007 | Sasaki et al. | |
| 7,268,289 | B2 | 9/2007 | Muramatsu et al. | |
| 7,285,715 | B2 | 10/2007 | Sasaki et al. | |
| 7,326,844 | B2 | 2/2008 | Nishida | |
| 7,332,663 | B2 | 2/2008 | Nishida | |
| 7,345,235 | B2 | 3/2008 | Izutani et al. | |
| 7,355,109 | B2 | 4/2008 | Muramatsu et al. | |
| 7,365,259 | B2 | 4/2008 | Nishida | |
| 7,368,644 | B2 | 5/2008 | Shirayangi et al. | |
| 7,390,956 | B2 | 6/2008 | Fujiwara | |
| 7,402,741 | B2 | 7/2008 | Funaki et al. | |
| 7,405,350 | B2 | 7/2008 | Sasaki | |
| 7,420,116 | B2 | 9/2008 | Fujiwara | |
| 7,432,429 | B2 | 10/2008 | Muramatsu et al. | |
| 7,432,430 | B2 | 10/2008 | Sasaki | |
| 7,435,895 | B2 | 10/2008 | Muramatsu | |
| 7,465,863 | B2 | 12/2008 | Nishida | |
| 7,485,798 | B2 | 2/2009 | Nishida | |
| 7,488,884 | B2 | 2/2009 | Ohno et al. | |
| 7,488,885 | B2 | 2/2009 | Watanabe | |
| 7,825,312 | B2 * | 11/2010 | Jones et al. | 84/243 |
| 8,148,620 | B2 * | 4/2012 | Jones et al. | 84/423 R |
| 2001/0007219 | A1 | 7/2001 | Uehara et al. | |
| 2001/0007220 | A1 | 7/2001 | Koseki et al. | |
| 2001/0007221 | A1 | 7/2001 | Uehara | |
| 2001/0035086 | A1 | 11/2001 | Sugiyama et al. | |
| 2002/0059862 | A1 | 5/2002 | Muramatsu et al. | |
| 2002/0062728 | A1 | 5/2002 | Muramatsu et al. | |
| 2002/0194986 | A1 | 12/2002 | Kato et al. | |
| 2003/0070526 | A1 | 4/2003 | Muramatsu et al. | |
| 2003/0110897 | A1 | 6/2003 | Itou | |
| 2004/0003708 | A1 | 1/2004 | Buchla | |
| 2004/0025674 | A1 | 2/2004 | Muramatsu et al. | |
| 2004/0168564 | A1 | 9/2004 | Koseki et al. | |
| 2004/0221711 | A1 | 11/2004 | Kato et al. | |
| 2005/0145087 | A1 | 7/2005 | Fujiwara | |
| 2007/0000369 | A1 | 1/2007 | Okuyama | |
| 2012/0240743 | A1 * | 9/2012 | Jones et al. | 84/243 |

FOREIGN PATENT DOCUMENTS

| | | | |
|---|---|---|---|
| DE | 10 2005 017758 | | 8/2006 |
| EP | 0573963 | A2 | 12/1993 |
| EP | 0617403 | A2 | 9/1994 |
| EP | 0689183 | A | 12/1995 |
| JP | 63216099 | | 9/1988 |
| JP | 0174807 | | 6/1992 |
| JP | 06059667 | | 8/1994 |
| JP | 6289853 | | 10/1994 |
| JP | 191664(A) | | 7/1995 |
| JP | 07210150 | | 8/1995 |
| JP | 07271347(A) | | 10/1995 |
| JP | 8036380 | | 2/1996 |
| JP | 8063149(A) | | 3/1996 |
| JP | 8123403 | | 5/1996 |
| JP | 2737590 | | 1/1998 |
| JP | 2901864 | | 3/1999 |
| JP | 2000322052 | | 11/2000 |
| JP | 3203784 | | 6/2001 |
| JP | 3279307 | | 2/2002 |
| JP | 3292164 | | 3/2002 |
| JP | 3364354 | | 10/2002 |
| JP | 3360390(B2) | | 12/2002 |
| JP | 2003-084753 | | 3/2003 |
| JP | 3438308(B2) | | 8/2003 |
| JP | 3456243 | | 8/2003 |
| JP | 2003066947 | | 8/2003 |
| JP | 3485966 | | 10/2003 |
| JP | 2004094277 | | 3/2004 |
| JP | 3569660 | | 6/2004 |
| JP | 3714349 | | 2/2005 |
| JP | 2005134926 | | 5/2005 |
| JP | 3693047 | | 7/2005 |
| JP | 2005258461 | | 9/2005 |
| JP | 3873522 | | 2/2006 |
| JP | 3823999 | | 7/2006 |
| JP | 3832500 | | 7/2006 |
| JP | 3861906 | | 10/2006 |
| WO | WO 00/70600 | | 11/2000 |
| WO | WO 2009/017961 | | 2/2009 |

OTHER PUBLICATIONS

International Search Report and Written Opinion in connection with International Application No. PCT/US2009/032097, dated Jul. 16, 2009.

International Search Report and Written Opinion in connection with International Application No. PCT/US2009/043767, dated Aug. 11, 2009.

* cited by examiner

HAMMER STOPPERS FOR PIANOS HAVING ACOUSTIC AND SILENT MODES

This application is a continuation-in-part of U.S. patent application Ser. No. 12/429,485, filed Apr. 24, 2009, now allowed, the entire contents of which are incorporated herein by reference.

TECHNICAL FIELD

This disclosure relates to hammer stoppers and use thereof in pianos playable in both acoustic and silent modes.

BACKGROUND

An acoustic piano employs distinct and separate systems to transfer energy from a finger or actuator input force into an auditory, vibrational force. The transmission system, commonly called "the action", is a network of levers, cushions and hammers that accepts finger/actuator input force through a collection of pivotal levers, known as "keys". The keys and action focus this input force into rotating hammers of proportional density that are positioned to strike against tensioned wire strings. Both hammers and their corresponding strings are carefully constructed to match their acoustic properties, resulting in a tapered or graduated "scale" of components that cumulatively produce a multiple note span of musical frequencies. The strings act as medium through which vibrational energy is transferred into an amplifier, such as a soundboard or electric speaker, where it ultimately is converted into audible sound.

Pianos can produce a wide range of volume. Large pianos can further expand this range to include very loud sounds, as heard in concert pianos that are constructed to broadcast over an orchestra without the assistance of electric amplification. Pianos are prevalent in many cultures worldwide. They are present in many households, schools, institutions, etc. Inevitably, this proximity of volume-producing instruments creates situations where sound control and sound reduction are necessary. Many piano manufacturers provide muting mechanisms within their pianos to selectively restrict volume level. These mechanisms typically include a rotating rail that temporarily places an impact-absorbing material of varying density between the hammers and strings.

SUMMARY

According to one aspect of the disclosure, a piano hammer stopper system comprises a stopper rail set comprising at least a first stopper rail member and a second stopper rail member, each movable between respective first positions, allowing unobstructed movement of associated piano hammers, and respective second positions, stopping at least one associated piano hammer from striking any corresponding string; at least one drive shaft rotatably coupled to one or both of the first and second stopper rail members of the stopper rail set; a drive arm attached to the at least one drive shaft and engaging a drive fulcrum; and at least one travel guide directing movement of one or both of the first and second stopper rail members of the stopper rail set between respective first and second positions; wherein rotation of the at least one drive shaft rotates the drive arm to engage the drive fulcrum for moving one or both of the first and second stopper rail members of the stopper rail set between its respective first and second positions.

Implementations of this aspect of the disclosure may include one or more of the following features. The at least one drive shaft is coupled to both the first and second stopper rail members of the stopper rail set, and both first and second stopper rail members are moved in unison between respective first and second stopper positions. The at least one drive shaft comprises: a first drive shaft coupled to the first stopper rail member of the stopper rail set, and a second drive shaft coupled to the second stopper rail member of the stopper rail set, and the first and second stopper rail members are moved independently between respective first and second stopper positions. The drive arm defines a slot configured to receive the drive fulcrum, the drive arm pivoting about and sliding with respect to the received drive fulcrum. The drive arm comprises first and second drive arm portions slidably engaging one another, the first drive arm portion attached to the stopper rail, and the second drive arm portion pivotally coupled to the drive fulcrum. The at least one travel guide comprises at least one guide shaft received by a guide way, the at least one guide shaft attached to at least one of the first and second stopper rails of the stopper rail set and at least one support member of the hammer stopper system. The at least one travel guide defines a guide way configured to receive the at least one drive shaft. At least one of the first and second stopper rail members of the stopper rail set is biased toward one of its respective first and second positions. The at least one drive shaft is flexible for following the general shape of the stopper rail set. The piano hammer stopper system further comprises a shaft rotator coupled to the at least one drive shaft for rotating the at least one drive shaft. The shaft rotator comprises a lever defining an aperture for a receiving a pivot, rotation of the lever about the pivot moving the at least one drive shaft vertically with respect to the pivot and rotating the drive shaft with respect to the stopper rail set. The piano hammer stopper system further comprises an arm rotator coupled to the drive arm for pivoting the drive arm with respect to the drive fulcrum. The first and second stopper rail members are supported by robust mounting brackets and linkage hardware designed and constructed to resist deflection and/or displacement of associated first and second stopper rails members when struck by one or multiple piano hammers during silent play mode. The first and second stopper rail members are supported at inner, opposed ends by an additional robust mounting bracket disposed therebetween, with additional linkage hardware extending between the additional mounting bracket and each of the opposed stopper rail member ends. The stopper rail set, or at least one of the first and second stopper rail members of the stopper rail set, varies along its length in a manner to cause feel of a piano key strike against a stopper rail in silent play mode to vary along the length of the stopper rail replicating variation in feel of piano key strike against strings of the piano in acoustic play mode along the length of a piano action. The stopper rail set varies along its length in one or more characteristics selected from among: dimension, shape, mass, stiffness, associated mounting bracket, linkage hardware dimensions, type, thickness, and effectiveness of padding.

According to another aspect of this disclosure, a piano playable in an acoustic mode and a silent mode comprises a series of keys; a series of key actions, each key action actuated by depression of a corresponding key; a series of rotatable hammers, each rotatable hammer defining a forward throw direction and having at least one corresponding string, the hammers being driven by corresponding key actions transferring forces from corresponding keys; and a hammer stopper system comprising a stopper rail set comprising a first stopper rail member and a second stopper rail member, each movable between a respective first position, allowing unobstructed movement of associated piano hammers, and a respective second position, stopping at least one associated piano hammer from striking any corresponding string; and at least one rail actuator assembly coupled to at least one of the first stopper rail member and the second stopper rail member of the stopper rail set, the at least one rail actuator assembly comprising at least one drive shaft rotatably coupled to one or both of the first and second stopper rail members of the stopper rail set; a drive arm attached to the at least one drive shaft and engaging a drive fulcrum; and at least one travel guide directing movement of one or both of the stopper rail members of the stopper rail set between its respective first and second positions; wherein rotation of the at least one drive shaft rotates the drive arm to engage the drive fulcrum for moving one or both of the stopper rail members of the stopper rail set between its respective first and second position.

Implementations of this aspect of the disclosure may include one or more of the following features. The at least one drive shaft is coupled to both the first and second stopper rail members of the stopper rail set, and both first and second stopper rail members are moved in unison between respective first and second stopper positions. The at least one drive shaft comprises: a first drive shaft coupled to the first stopper rail member of the stopper rail set, and a second drive shaft coupled to the second stopper rail member of the stopper rail set, and the first and second stopper rail members are moved independently between respective first and second stopper positions. The drive arm defines a slot configured to receive the drive fulcrum, the drive arm pivoting about and sliding with respect to the received drive fulcrum. The drive arm comprises first and second drive arm portions slidably engaging one another, the first drive arm portion attached to the stopper rail, and the second drive arm portion pivotally coupled to the drive fulcrum. The at least one travel guide comprises at least one guide shaft received by a guide way, the at least one guide shaft attached to at least one of the first and second stopper rail members of the stopper rail set and at least one support member of the hammer stopper system. The at least one travel guide defines a guide way configured to receive the at least one drive shaft. At least one of the first and second stopper rail members of the stopper rail set is biased toward one of its respective first and second positions. The at least one drive shaft is flexible for following the shape of the stopper rail set. The piano further comprises a shaft rotator coupled to the drive shaft for rotating the at least one drive shaft. The shaft rotator comprises a lever defining an aperture for a receiving a pivot, rotation of the lever about the pivot moving the drive shaft vertically with respect to the pivot and rotating the drive shaft with respect to the stopper rail set. The piano further comprises an arm rotator coupled to the drive arm for pivoting the drive arm with respect to the drive fulcrum. The piano further comprises a mode selection switch in communication with the at least one rail actuator assembly and controlling movement of the first and second stopper rail members of the stopper rail set between the respective first and second positions. The mode selection switch is engaged by a pedal of the piano. The piano further comprises a controller in communication with the at least one rail actuator assembly and controlling switching between the acoustic play mode and the silent play mode. The first and second stopper rail members are supported by robust mounting brackets and linkage hardware designed and constructed to resist deflection and/or displacement of associated first and second stopper rails members when struck by one or multiple piano hammers during silent play mode. The first and second stopper rail members are supported at inner, opposed ends by an additional robust mounting bracket disposed therebetween, with additional linkage hardware extending between the additional mounting bracket and each of the opposed stopper rail member ends. The stopper rail set varies along its length in manner to cause feel of a piano key strike against a stopper rail in silent play mode to vary along the length of the stopper rail replicating variation in feel of piano key strike against strings of the piano in acoustic play mode along the length of a piano action. At least one of the first and second stopper rail members of the stopper rail set varies along its length in manner to cause feel of a piano key strike against a stopper rail in silent play mode to vary along the length of the stopper rail replicating variation in feel of piano key strike against strings of the piano in acoustic play mode along the length of a piano action. The stopper rail set varies along its length in one or more characteristics selected from among: dimension, shape, mass, stiffness, associated mounting bracket, linkage hardware dimensions, type, thickness, and effectiveness of padding.

According to yet another aspect of this disclosure, a hybrid upright piano having selectable silent play mode and acoustic play mode comprises: a stopper rail selectably moveable between blocking and non-blocking positions, the stopper rail associated with mounting brackets at opposite ends by stopper rail adjustment screws disposed for rotation in horizontal arrangement relative to the mounting brackets with exposed screw heads fixed axially and rotatable at the mounting bracket, and with a body disposed in threaded engaged with the stopper rail and an associated locknut mounted thereto, wherein rotation of the exposed screw head with a tool disposed horizontally and in general axial alignment with the threaded screw body acts, by threaded engagement of the screw body and stopper rail and locknut, to adjust a horizontal position of the stopper rail relative to an opposed piano string plane for stopping piano key strike against associated piano string during silent play mode.

Implementations of this aspect of the invention may include the following feature. The hybrid upright piano further comprises a travel guide mounted to the piano action and defining a generally horizontal surface disposed to slidably support stopper bar movement between blocking and non-blocking positions.

According to yet another aspect of this disclosure, a method for adjusting stopper rail position in a hybrid upright piano having selectable silent play mode and acoustic play mode, comprising the steps of: selecting silent play mode to place a stopper rail in silent play stopper position; with one hand, holding a piano hammer against the stopper rail; using the other hand to turn a screwdriver in engagement with a screw head an axially fixed, rotatable adjustment screw in threaded engagement with the stopper rail and associated locknut mounted thereto; watching as spacing between the held piano hammer and the piano strings changes while the adjustment screw is turned; continuing to turn the screwdriver in either direction until desired spacing is achieved; and completing adjustment by discontinuing screw turning.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 6 is front perspective view of a hammer stopper rail frame assembly of the disclosure for an upright piano, while FIG. 6A is an enlarged front perspective view of an end mounting bracket of the hammer stopper rail frame assembly of FIG. 6.

FIG. 7 is a front perspective view of a hammer stopper rail assembly of the disclosure for an upright piano, while FIG. 7A is an enlarged front perspective view of an additional mounting bracket and linkage hardware for the mid-scale position of the hammer stopper rail assembly of FIG. 7A.

FIG. 8 is rear perspective view of the hammer stopper rail assembly of FIG. 7, while FIG. 8A is an enlarged rear perspective view of the additional mounting bracket and linkage hardware for the mid-scale position of the hammer stopper rail assembly of FIG. 7A.

Like reference symbols in the various drawings indicate like elements.

DETAILED DESCRIPTION

The present disclosure provides a hammer stopper system that may be incorporated in grand (horizontal) and upright pianos. In some configurations, as described below, the hammer stopper system can be retrofit into existing pianos, and/or removed, e.g., for ease of maintenance. Implementations of the hammer stopper system of this disclosure are illustrated for a grand piano, e.g., in FIGS. 1, 2, 4, 9-15, and 21, and for an upright piano, e.g., in FIGS. 3, 5-8, and 16-20.

Figure 1:
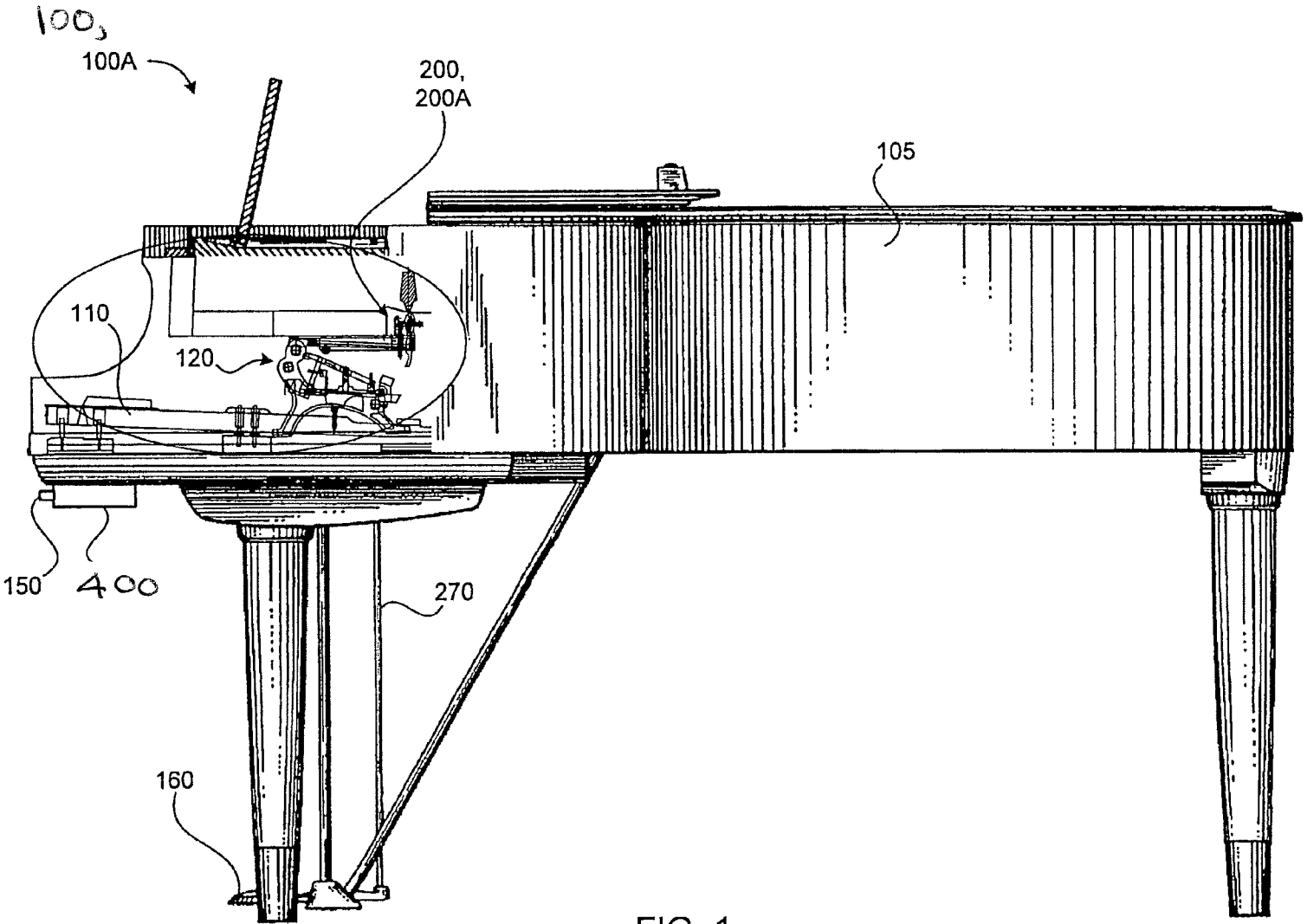
FIG. 1 is a side view of a grand (horizontal) piano with a hammer stopper system of the disclosure.
Figure 2:
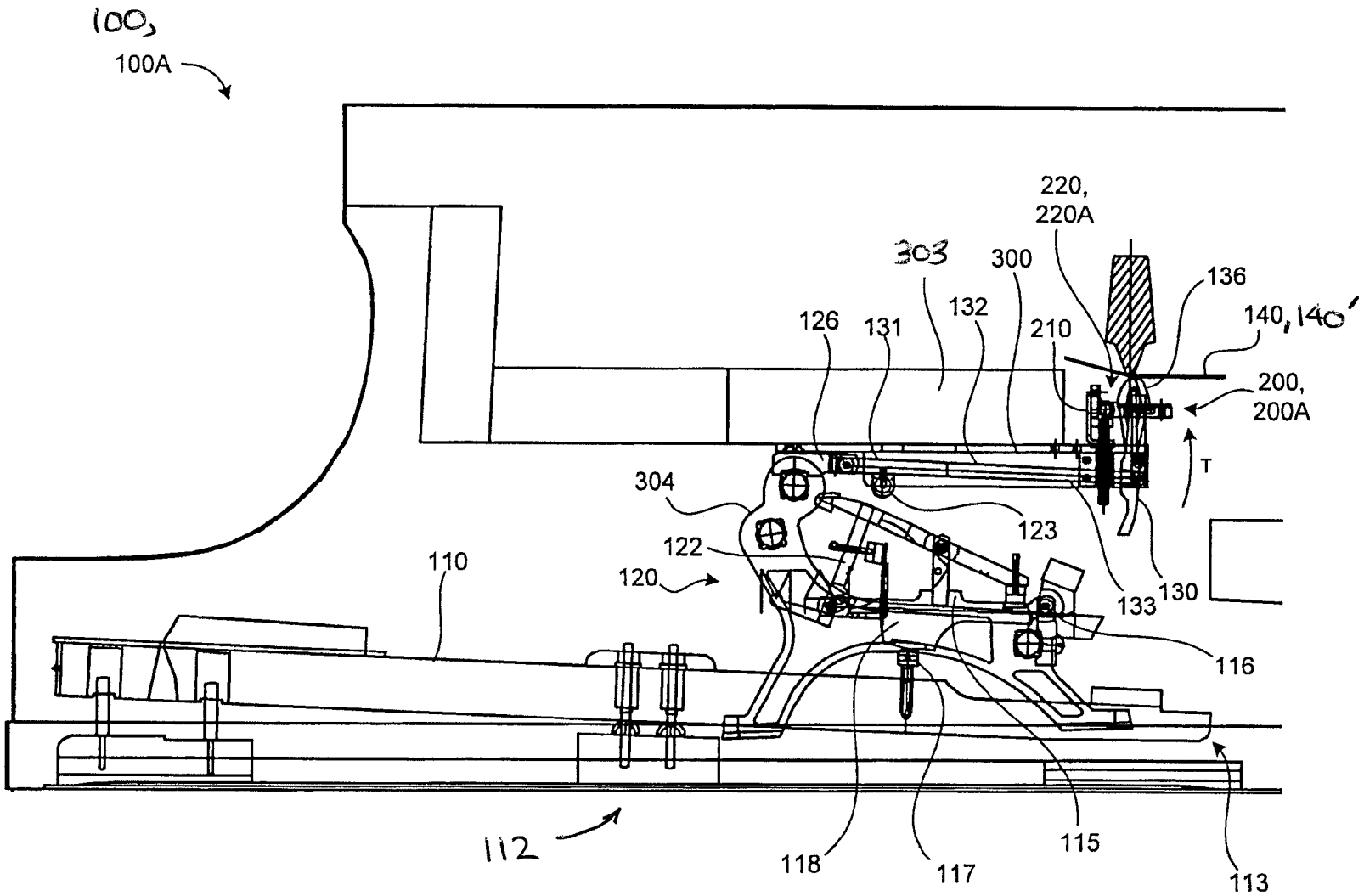
FIG. 2 is a side view of a grand piano action with a hammer stopper system of the disclosure.
Figure 3:
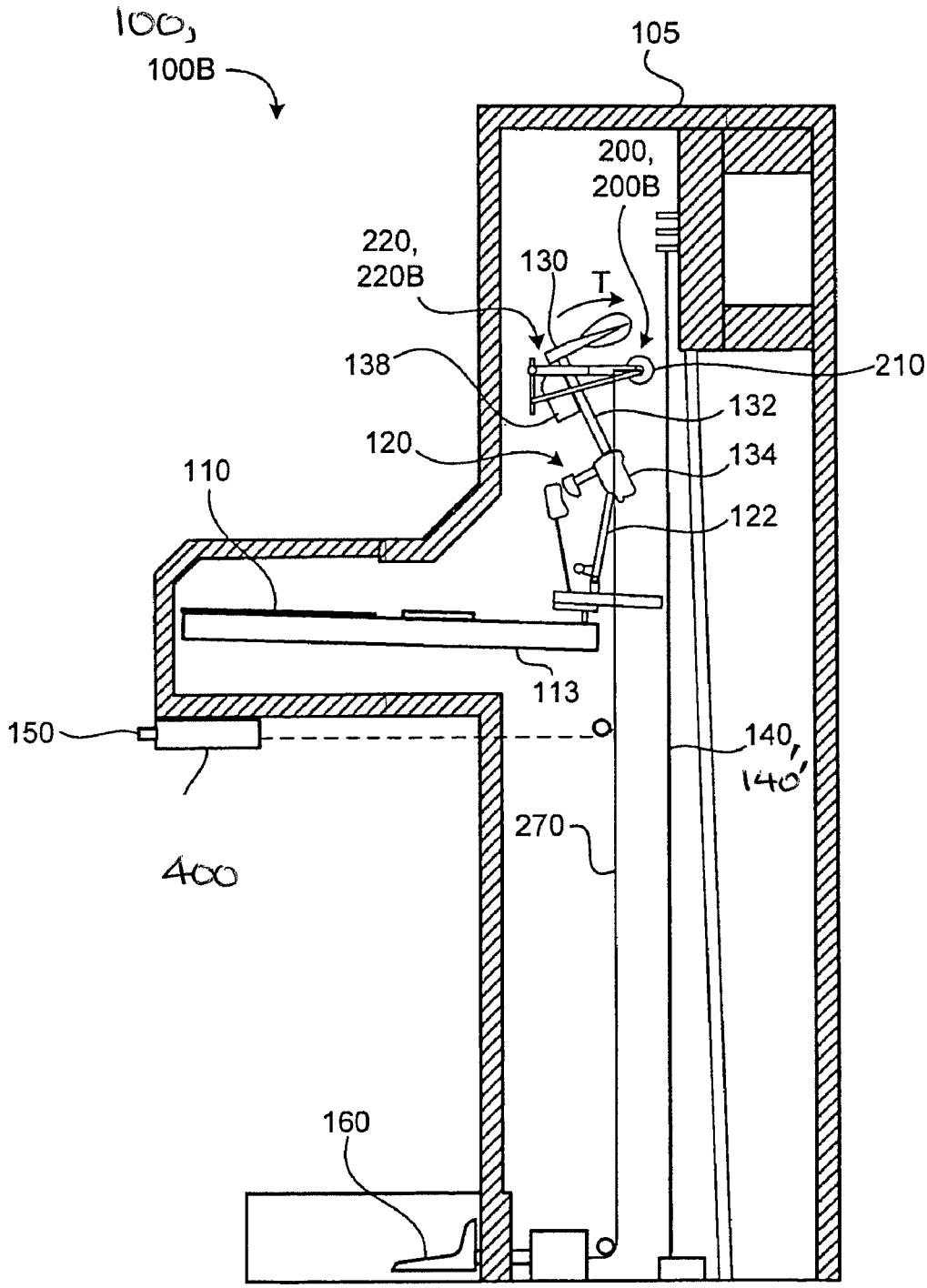
FIG. 3 is a side view of an upright piano with a hammer stopper system of the disclosure.

Referring to FIGS. 1-3, a piano 100, 100A (grand piano), 100B (upright piano) playable selectively in an acoustic mode and a silent mode, includes a series of keys 110 and corresponding key actions 120 linked to rear ends 113 of the keys 110. Each key action 120 is actuated by depressing a corresponding key 110. A series of rotatable hammers 130, each defining a forward throw direction, T, are driven by corresponding key actions 120, which transfer forces from corresponding pressed keys 110. Each hammer 130 is aligned to strike a corresponding string 140, or group of strings 140', upon being thrown. For example, the hammer 130 may strike between one and three strings 140, 140' to provide the desired note of the corresponding depressed key 110. For note 1 to notes 8 (or 10 or 12, depending on the piano size), the strings 140 per hammer 130 may be unichords, meaning one string per note. For approximately note 11 to note 20 (or 30) or any note therebetween, depending on the piano scale, the strings 140 per hammer 130 may be bichords, meaning two strings 140 per note. For note 20 (or 30) through to note 88, depending on the piano scale, the strings 140 per hammer 130 may be trichords, meaning three strings 140 per note. As such, when referring to a string 140, as in a corresponding string 140 of a hammer 130, it may include a group or set of strings 140' (e.g., one or more strings 140).

Referring to FIGS. 1 and 2, in an exemplary grand (e.g. horizontal) piano 100A, each key 110 is supported at a fulcrum 112, and the rear end 113 of each key 110 may support a backcheck (not shown). A wippen lever 115 is pivotally connected to a structural assembly of the piano 110A for pivoting about pivot 116. A jack 122 is pivotally connected to the wippen lever 115. An adjustable capstan 117, attached to the key 110, contacts a wippen butt 118 on the wippen lever 115 and raises the wippen lever 115 when the key 110 is depressed. The raised wippen lever 115 causes the jack 122, in contact with a hammer knuckle 123, to pivot an associated hammer 130, which is pivotally connected to a hammer flange 126. Further motion of the wippen lever 115 causes the jack 122 to move out of contact with the hammer knuckle 123, i.e. to disengage, as the hammer 130 is thrown along a throw direction, T, for striking a corresponding string 140 or set of strings 140'.

Referring also to FIG. 3, in an exemplary upright piano 100B, each hammer 130 includes a hammer shank 132, a butt 134 attached to a first end 131 of the shank 132, and hammer 130 attached to an opposite, second end 133 of the shank 132. A depressed or actuated key 110 causes a jack 122 of the associated key action 120 to kick the butt 134 of the hammer 130. When the jack 122 kicks the butt 134, the butt 134 and the hammer shank 132 are driven for rotation toward the associated strings 140. The hammer 103 strikes the string(s) 140, producing an acoustic sound. When the keys 110 are in a rest position (e.g. when a player is not pressing the keys 110), the hammers 130 remain in home positions, resting on a hammer resting rail 138 and/or the jack 122.

Referring to FIGS. 2 and 3, a hammer stopper system 200, 200A (for a grand piano), 200B (for an upright piano) includes a stopper rail 210 disposed between the hammers 130 and the strings 140, and a rail actuator assembly 220 configured to move the stopper rail 210 between a first position, allowing unobstructed movement of the hammers 130, and a second position stopping at least one hammer 130 from striking its corresponding string(s) 140. For example, in a grand piano, the rail actuator assembly 220 moves the stopper rail 210 to the first position (FIGS. 9 and 12) for acoustic play and to the second position (FIGS. 11 and 13) for silent play. In some implementations, as with grand pianos 100A (FIG. 2), the hammer stopper system 200, 200A is disposed substantially between the hammers 130 and strings 140. In other implementations, as with upright pianos 100B (FIG. 3), portions of the hammer stopper system 200, 200B are disposed on both sides of the hammers 130 with respect to the strings 140.

The hammer stopper system 200A (e.g. for a grand piano) includes a rail actuator assembly 220A with a drive shaft 230 disposed along the stopper rail 210. The drive shaft 230 rotates with respect to the stopper rail 210 and may be a rigid shaft (e.g., bar stock) or a flexible shaft, which transmits rotation and torque while remaining flexible to bend along any curves of the stopper rail 210. In some examples, the drive shaft 230 is routed through or along a channel 212 (FIG. 12) defined by the stopper rail 210. The channel 212 may be an open or enclosed channel or throughway. The rail actuator assembly 220 includes at least one drive arm assembly 225 disposed along the drive shaft 230. The stopper rail 210 may be have a break in continuity, flex joint, or other device for allowing flexing of the stopper rail at the drive arm assembly 225, as discussed in more detail below. The drive arm assembly 225 includes a drive arm 240 attached to the drive shaft 230 and slidably coupled to a support member 300, which may be attached to a pin block 303 or an action bracket 304. Rotation of the drive shaft 210 causes rotation of the drive arm 240, which engages a drive arm fulcrum 244 to move the stopper rail 210 between its first (non-stopper) position and its second (stopper) position. The drive arm fulcrum 244 may be disposed on a mounting bracket or support member 300. The support member 300 may be attached to a pin block 303 or an action bracket 304. The rail actuator assembly 220A includes one or more travel guides 260 configured to guide movement of the stopper rail 210 along a travel path between its first and second positions. In the example shown, the travel path is a substantially linear path, while in other implementations, the travel path may be parabolic or non-linear. The stopper rail 210 may include a hammer cushion 211 (FIG. 12) positioned to receive and absorb the impact of a thrown hammer 130.

Figure 4:
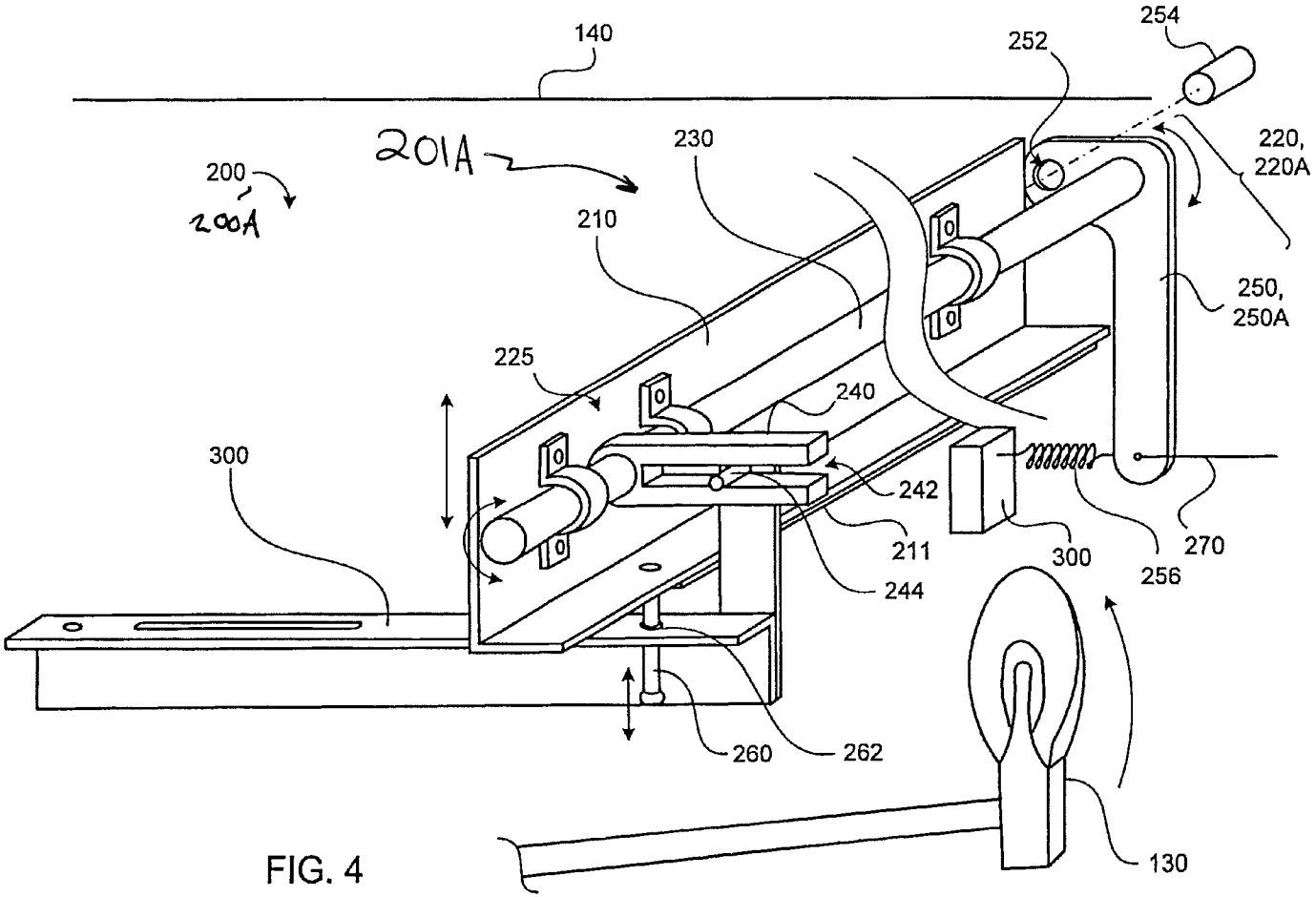
FIG. 4 is a perspective view of a hammer stopper system of the disclosure for a grand piano.

Referring to FIG. 4, the rail actuator assembly 220A (e.g., for a great piano) includes a shaft rotator 250 coupled to the drive shaft 230 for rotating the drive shaft 230 and the attached drive arm(s) 240 between first and second positions for moving the stopper rail 210 between its corresponding first and second positions. Examples of the shaft rotator 250 include a lever 250A coupled to the drive shaft 230 and pivoted by an attached wire 270 or linkage, a rotary actuator (e.g., rotary motor) (not shown) coupled to the drive shaft 230, or a linear actuator, such as a solenoid. In examples using the lever 250A, the wire or linkage 270 may be coupled to a mode selection switch 150 (e.g., FIG. 17) or pedal 160 (e.g., FIG. 1) of the piano 100. In the example shown in FIG. 4, the lever 250A is attached to the drive shaft 230 for transferring rotation to the drive shaft 230. The lever 250A defines an aperture 252 for receiving a pivot 254 about which the lever 250A rotates. The pivot 254 may be attached to or defined by a portion of the piano case 105, a plate horn of the piano 100A, or a mounting bracket 300, which may be attached to the pin block 303 or an action bracket 304. A spring 256 may bias the lever 250A to rotate the drive shaft 230 and move the stopper rail 210 toward one of its first or second positions. The spring 256 may be attached to a portion of the piano case 105, a plate horn of the piano 100A, or a mounting bracket 300, which may be attached to the pin block 303 or an action bracket 304. Actuation of the attached wire 270 (e.g., by the mode selection switch 150A (FIG. 17)) moves the lever 250A for actuating the rail actuator assembly 220A. Rotation of the lever 250A about its pivot 254 moves the drive shaft 230 vertically along an arcuate path with respect to the pivot 254 and rotates the drive shaft 230 with respect to the stopper rail 210. The vertical movement of the drive shaft 230 with respect to the pivot 254 by the lever 250A moves the stopper rail 210 between its first and second positions at the lever 250A. The rotation of the drive shaft 230 by the lever 250A causes rotation of each drive arm 240 of each drive arm assembly 225 to engage its corresponding drive arm fulcrum 244 to move the stopper rail 210 between its first and second positions at each drive arm assembly 225. Each travel guide 260 maintains a vertical orientation of the stopper rail 210, thus preventing rotation of the stopper rail 210 about its longitudinal axis, as it moves vertically between its first and second positions.

In some implementations, e.g. for a grand piano, the hammer stopper system 200A is installed in a bass section of the piano 100A (e.g., approximately between notes 1 and 21) and also separately installed in a treble section of the piano 100A (e.g., approximately between notes 21 and 88). For example, referring to FIG. 4, a segment 201A of the hammer stopper system 200A in the bass section of the grand piano 100A is shown, including the shaft rotator 250 (e.g., lever arm 250A) that is substantially near note 1 and one drive arm assembly 225 that is substantially near note 21. The segment of the hammer stopper system in the treble section of the piano (not shown) may include the shaft rotator substantially near note 21 and drive arm assemblies substantially near notes 51, 69, and 88. In another implementation, the shaft rotator 250 for the treble section of the piano may be substantially near note 88, and the drive arm assemblies 225 may be substantially new notes 21, 51, and 69. In yet another implementation, the shaft rotator 250 for the treble section of the piano and the shaft rotator 250 for the bass section of the piano both may be substantially near note 21, and the drive arm assemblies 225 may be substantially new notes 1, and near note 51, 69, and 88. The shaft rotators 250 of the bass and treble segments and of the hammer stopper system 200A may be actuated in unison or independently of each other for silent or acoustic play of the respective piano sections.

Figures 5, 5A, 5B:
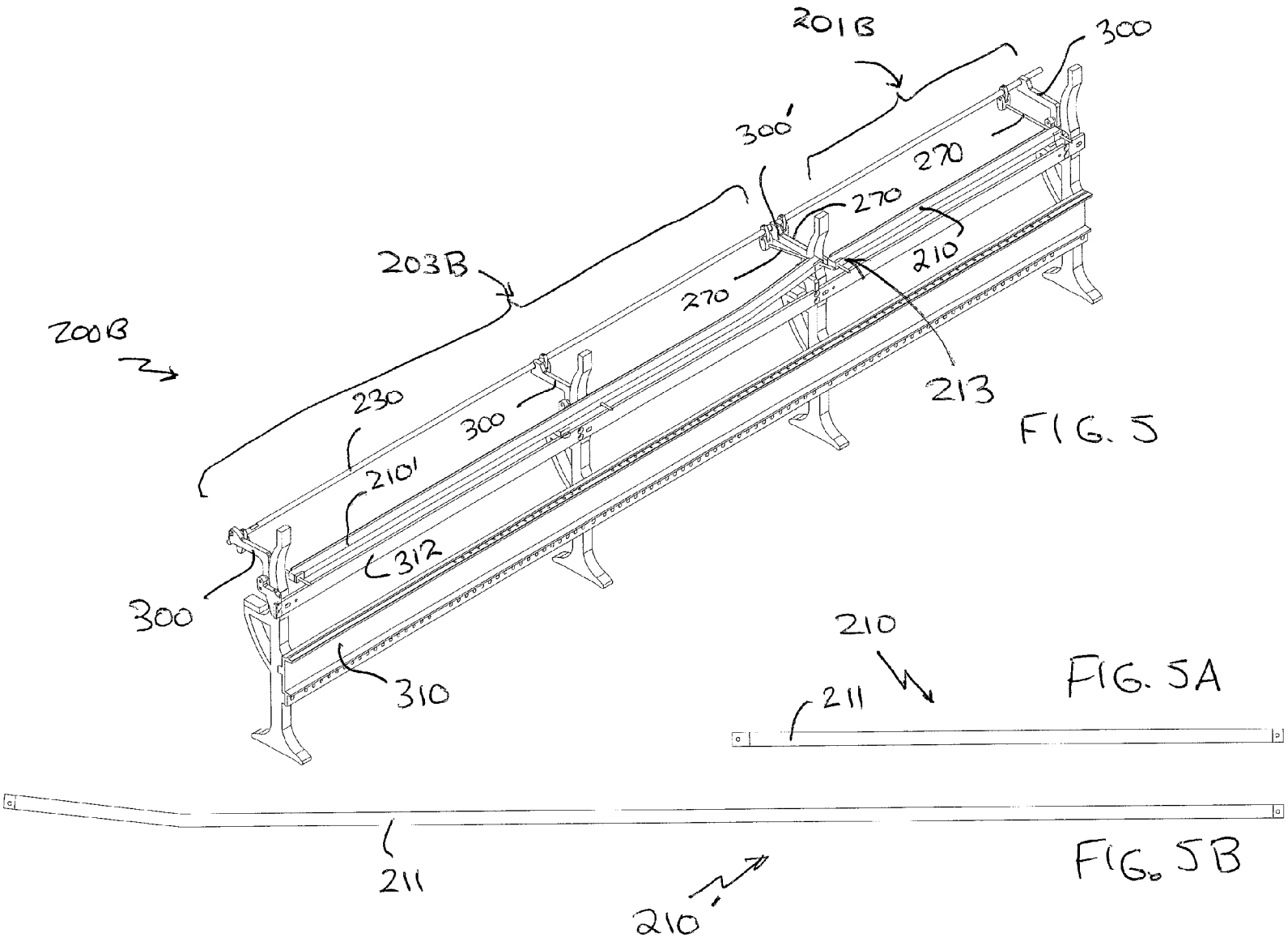
FIG. 5 is a front perspective view of a hammer stopper rail assembly of the disclosure, e.g. for an upright piano.
FIGS. 5A and 5B are face views of separate hammer stopper rails for the bass section of the upright piano and the a treble section of the upright piano, respectively.

In other implementations of this disclosure, e.g., for an upright piano, referring to FIGS. 5, 5A, and 5B, in another implementation of this disclosure, a first segment 201B of the hammer stopper system 200B is installed in a bass section of the upright piano 100B (e.g., approximately between notes 1 and 21) and a second segment 203B of the hammer stopper system 200B is installed separately in a treble section of the upright piano 100B (e.g., approximately between notes 26 and 88). The hammer stopper rail system 200B has two separate hammer stopper or stopper rails 210, 210'. In the implementation shown in the drawings, both rails are linked to a common actuation mechanism, but the stopper device itself, i.e. hammer stopper rail that directly receives the impact from piano hammers, is separated into two metal bars, i.e. bass section bar 210 and a treble section bar 210', each with a cushioned impact surface 211 positioned for engagement with the hammer shank 132. The bass section bar 210 (of length "$L_{bass}$") spans the bass section of the piano action, typically from notes 1 through 26 (or 1 through 27, or 1 through 34, etc.). The treble section bar 210' (of length "$L_{treble}$") spans a longer remaining region of the piano action, from low treble through high treble, typically from notes 27 through 88 (or from 28 through 88 or =36 through 88, etc.). In one implementation, stopper rail bars 210, 210' are steel bars with rectangular cross section, e.g. about 10 mm by 12 mm, disposed to extend horizontally in a region located just below the white felt hammers 130. The stopper rails may be attached to the supporting frame-linkage system 200B only at the ends of the rails, and thus could be considered "simple beams." The location 213 between the two stopper rails is called "the bass-treble nor break" or just "the break." In other implementations, a mounting bracket 300 is located at the mid-treble location, with the mounting bracket 300 supporting the drive shaft 230. In one arrangement, a linkage assembly 302 may also be provided at this location, which means a total of three linkages 302 on the treble stopper bar 210, 210', which can have the disadvantage of both shortening the effective beam length and making it relatively more difficult to adjust the position of the stopper bar 210, 210' relative to the plane of the strings 140, 140' (see discussion of FIGS. 17 and 18 below). Alternatively, in another arrangement, the linkage assembly 302 is omitted at the mid-treble location, which makes it relatively easier to adjust the position of the treble stopper bar relative to the strings, but also lengthens the effective beam length to be the full length of the rail 210, 210' (see discussion below).

The relatively shorter beam lengths of the two, separate stopper rails 210, 210' of this disclosure, each mounted at the ends, i.e., at notes 1 and 26, and at notes 27 and 88, respectively, results in relatively less beam deflection, e.g. compared to the relative length of standard one-piece bars. This arrangement differs from prior known hammer stopper rail systems, where the stopper rail is typically one continuous beam, extending from note 1 to note 88 and mounted only at the ends. The result is markedly less beam deflection, which means that stopper rail position can be regulated more closely, thereby minimizing the amount of piano action regulation compromises that are required, e.g. in manufacture and maintenance. This, in turn, permits the piano action "touch" to be better, in particular for more experienced and professional piano artists, and will make the piano easier to play well.

When the hybrid piano of this disclosure is played in silent mode, the piano hammers 130 strike (i.e., apply a force "f" to) the stopper rail 210 or 210'. During a typical 2- or 4-hand performance, multiple ("n", where n<=20) hammers strike the stopper rail simultaneously, applying a cumulative impact force "F" to the rail (F=n*f). This force "F" causes the stopper rail ("beam") to deflect. The deflection can be calculated using the Euler-Bernoulli beam bending equations. In the simplified case of a central point load on a simply supported beam of length "L", the equation for maximum deflection "w(max)" is:

$$\omega_{max}=c*F*L^3$$

where c is constant.

Thus, the longer the hammer stopper rail "L" (length), the greater the maximum deflection "$\omega_{max}$". Conversely, the shorter the hammer stopper rail "L" (length), the smaller the maximum deflection "$\omega_{max}$".

Since a piano equipped with a stopper rail assembly of the present disclosure is constructed with two separate, relatively shorter stopper rails [of lengths "$L_{bass}$" and "$L_{treble}$"], the values of "L" in the above equation are similarly relatively smaller than in traditional one-piece rail designs [with length $L_{88\ notes}$]:

$$L_{88\ notes}\sim L_{bass}+L_{treble}$$

Typically:

$$L_{bass}=23 \text{ to } 38\% \text{ of } L_{88\ notes};$$

and $$L_{treble}=77 \text{ to } 63\% \text{ of } L_{88\ notes}.$$

To calculate a representative deflection comparison, assuming that the cross-section and material properties of the stopper rails to be compared remain unchanged, and assuming a median distribution of stopper rail lengths of 30/70 for the bass/treble rails in the two-piece system. In the two-piece stopper rail system, the maximum deflection will occur in the middle of the longer treble rail, which has length:

$$L_{treble}=77\%*L_{88\ notes}$$

For the treble rail in the two-piece system, $$\omega_{max}=c*F*(0.7*L_{88\ notes})^3$$

$$\omega_{max}=0.34*F*(L_{88\ notes})^3$$

For the rail in the one-piece rail system, $$\omega_{max}=c*F*(L_{88\ notes})^3$$

Therefore:

$$\omega_{max}(\text{two-piece stopper rail system})=0.34*\omega_{max}(\text{one-piece stopper rail system})$$

As the preceding calculation shows, the maximum deflection of either stopper rail 210, 210' in the two-piece system is ~34% of the maximum deflection of the stopper rail in the one-piece system. This smaller maximum deflection reduces the likelihood of the hammers accidentally striking the strings (and causing a sound) during forte playing in silent mode. This in turn allows the stopper rail assembly adjustment (regulation) to be brought closer to the string plane.

All hybrid pianos require action regulation (mechanical adjustment) compromises. These compromises detract from the desirable "feel" (mechanical responsiveness) of the action, because the action must be adjusted to function with an additional stop location (at the hammer stop rail, during silent mode), in addition to the normal hammer stop location (at the strings, during acoustic mode). The greater the rotational distance between the stopper rail 210, 210' and the piano strings 140, 140', the larger the action regulation compromise, the worse the action feels to the pianist, and the harder it is to play the piano well. Conversely, the smaller the rotational distance between the stopper rail 210, 210' and the piano strings 140, 140', the smaller the action regulation compromise, the better the action feels, and the easier it is to play the piano well.

Since the maximum deflection in a two-piece stopper rail system is approximately 34% of the maximum deflection in a one-piece stopper rail system, the stopper rails in the two-piece system can be set to be closer to the strings. This reduces the rotational distance between the stopper rail and the strings, and this reduced rotational distance means that the required action regulation compromises are smaller. The result is a better feeling action and a piano that is easier to play well.

Figures 6, 6A:
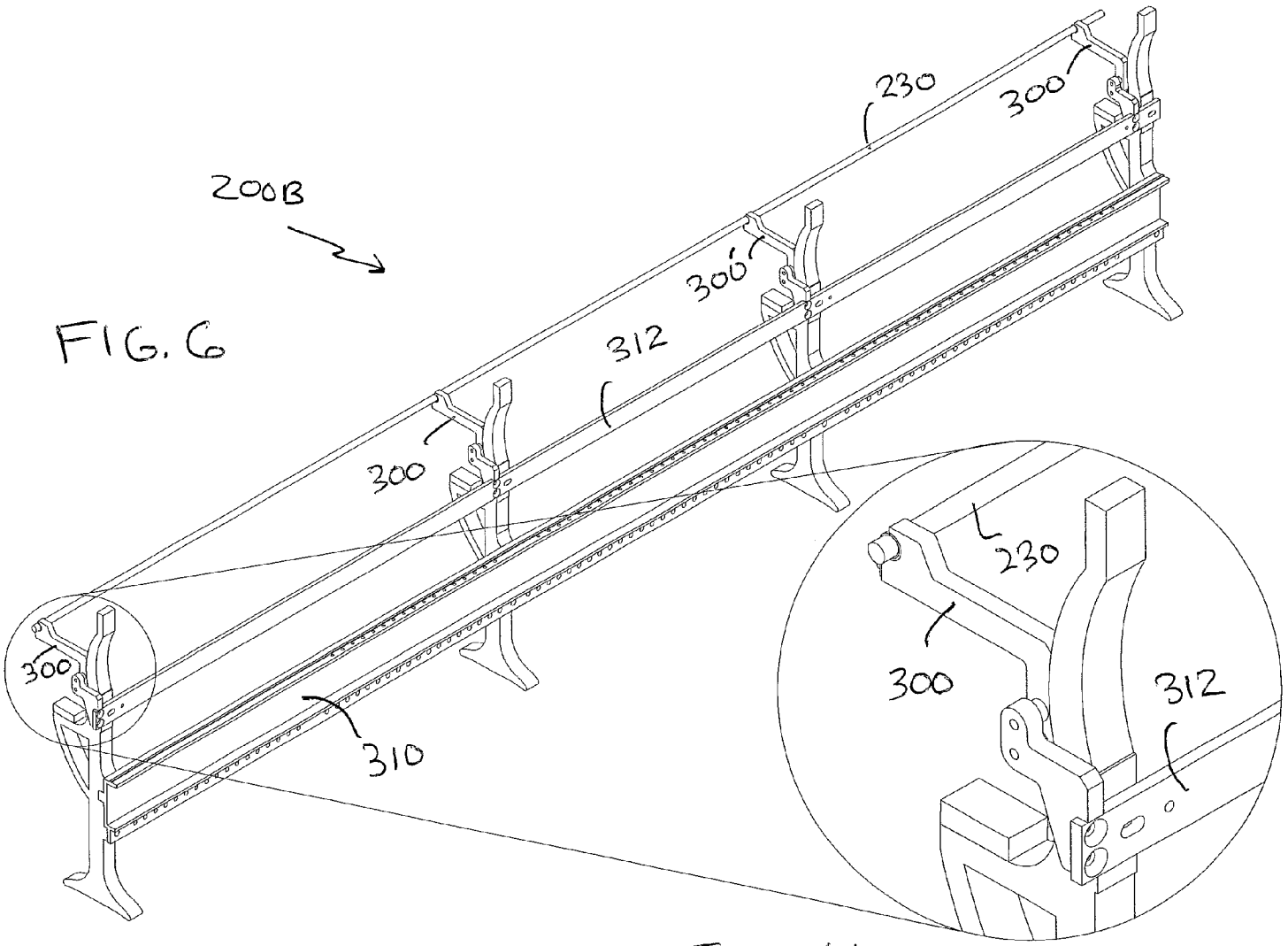
Figures 7, 7A:
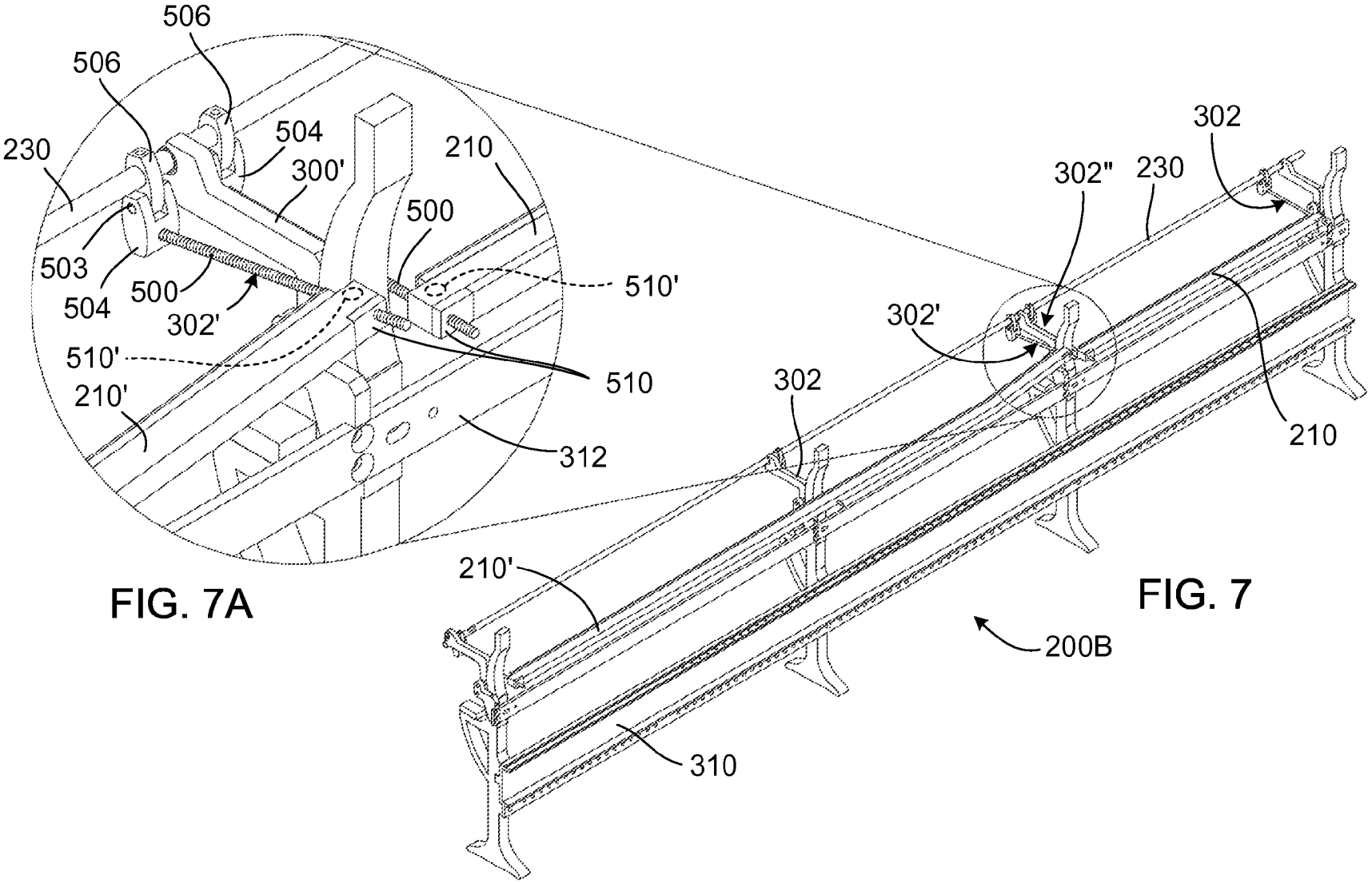
Figures 8, 8A:
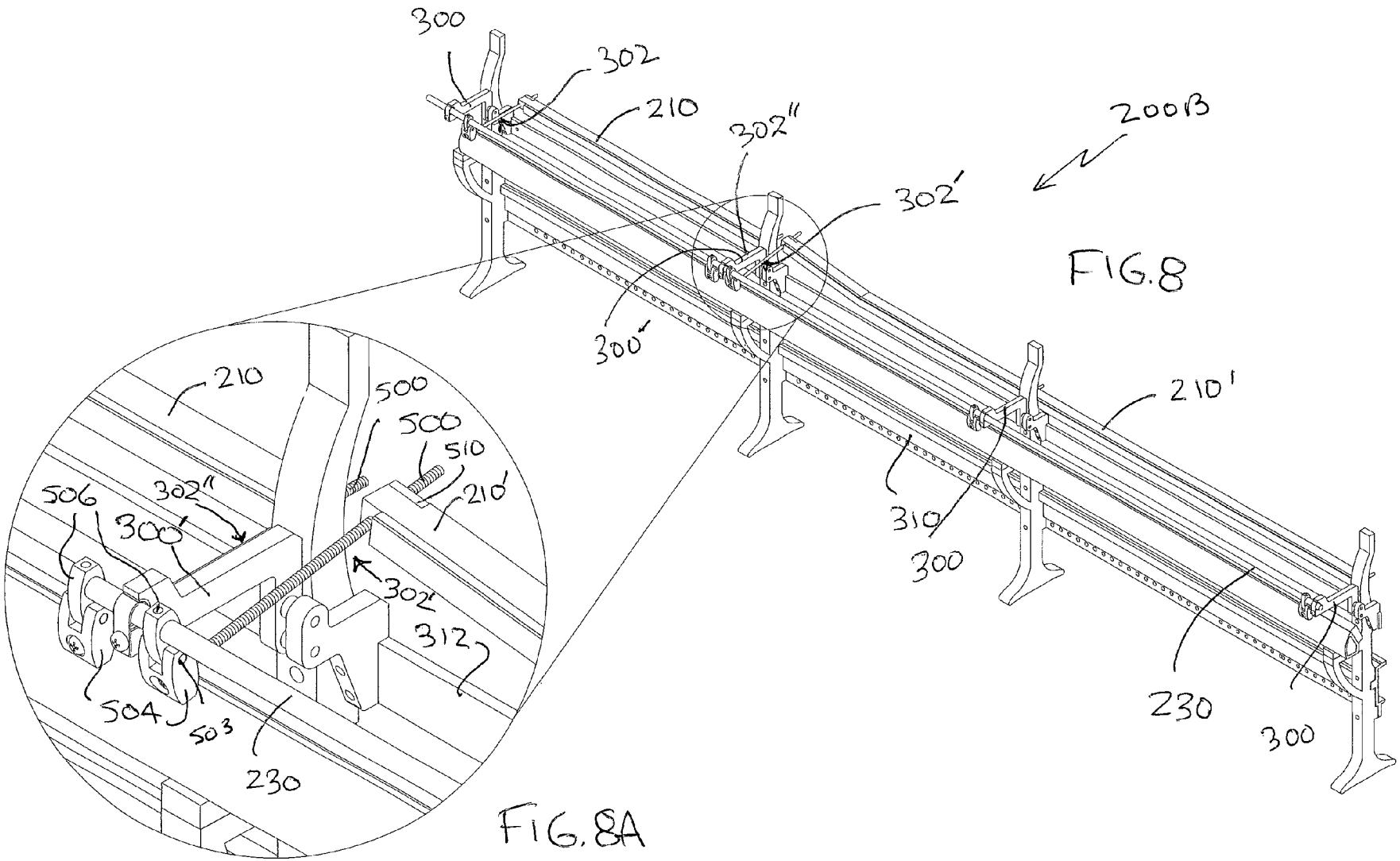
Figure 9:
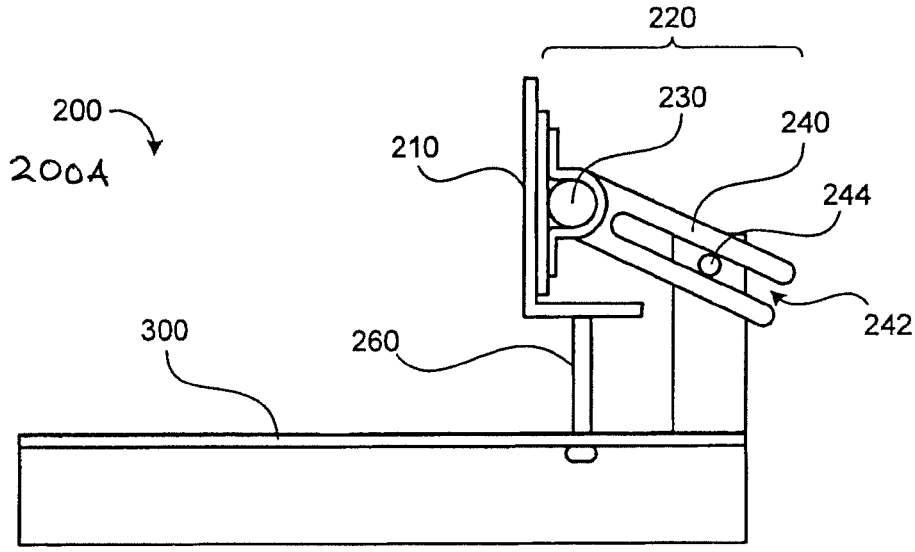
FIG. 9 is a side view of a hammer stopper system of the disclosure for a grand piano in an acoustical mode/non-stopper position.
Figure 10:
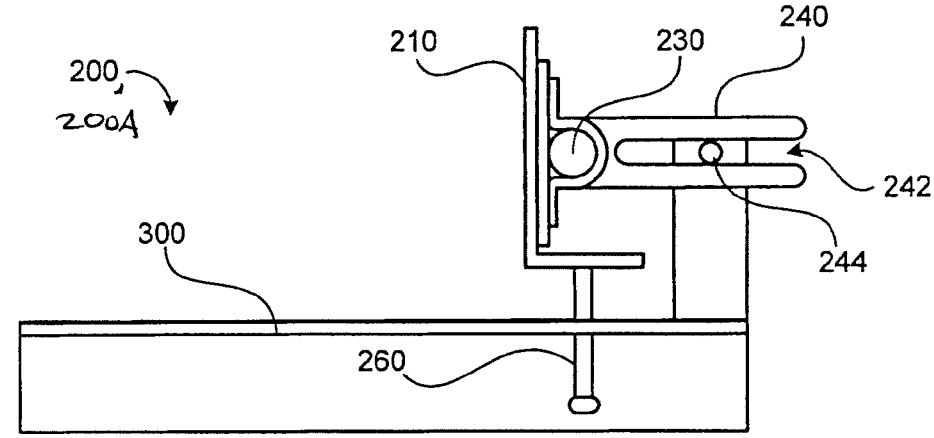
FIG. 10 is a side view of the hammer stopper system of FIG. 9 in an intermediate position.
Figure 11:
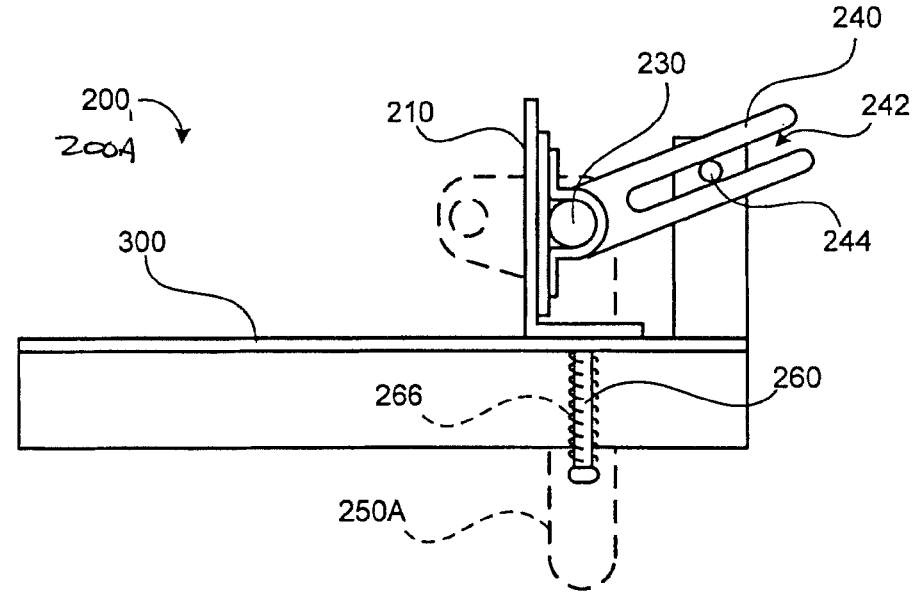
FIG. 11 is a side view of the hammer stopper system of FIG. 9 in a silent mode/stopper position.
Figure 12:
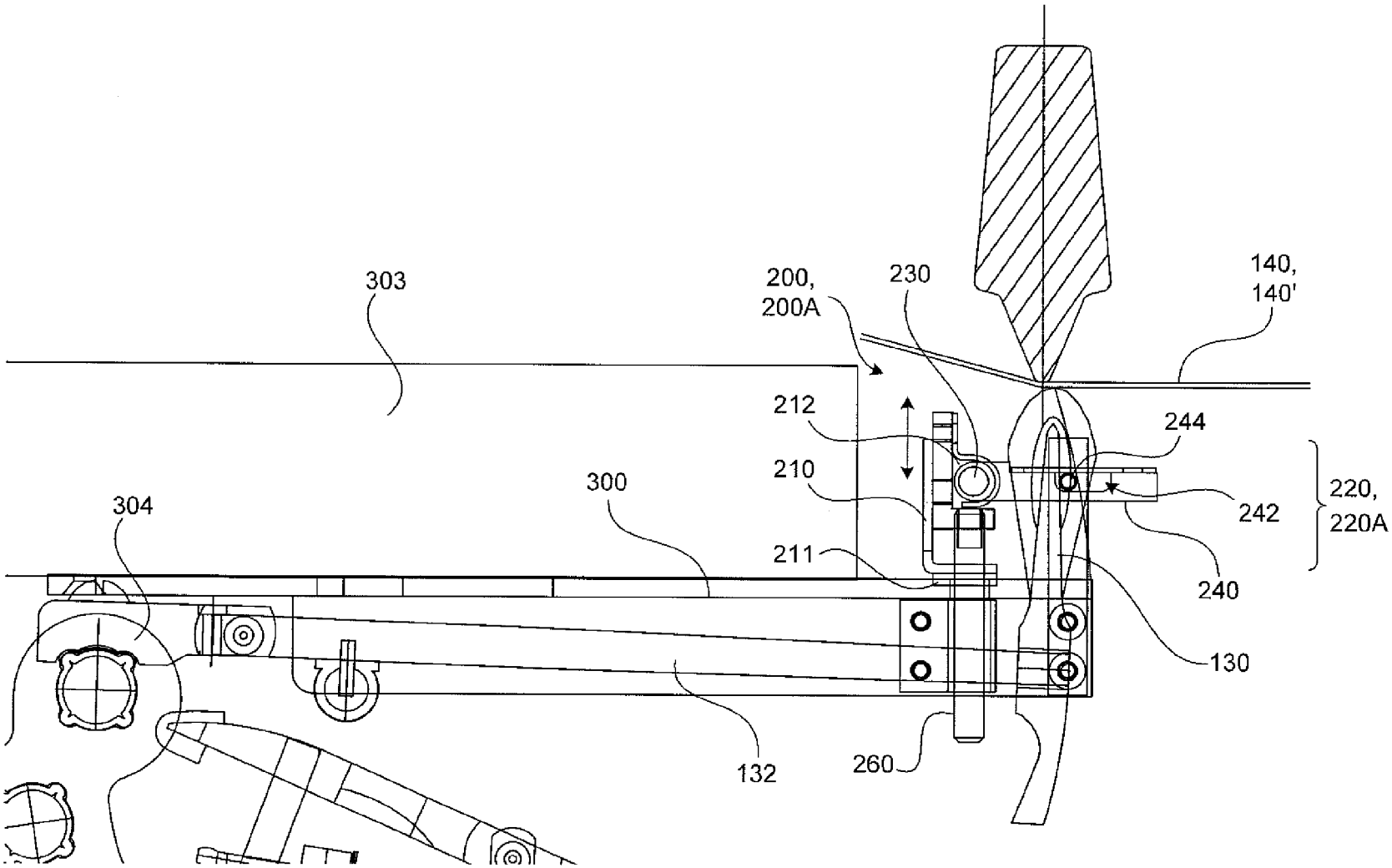
FIG. 12 is a side view of a hammer stopper system of the disclosure in an acoustical mode/non-stopper position.
Figure 13:
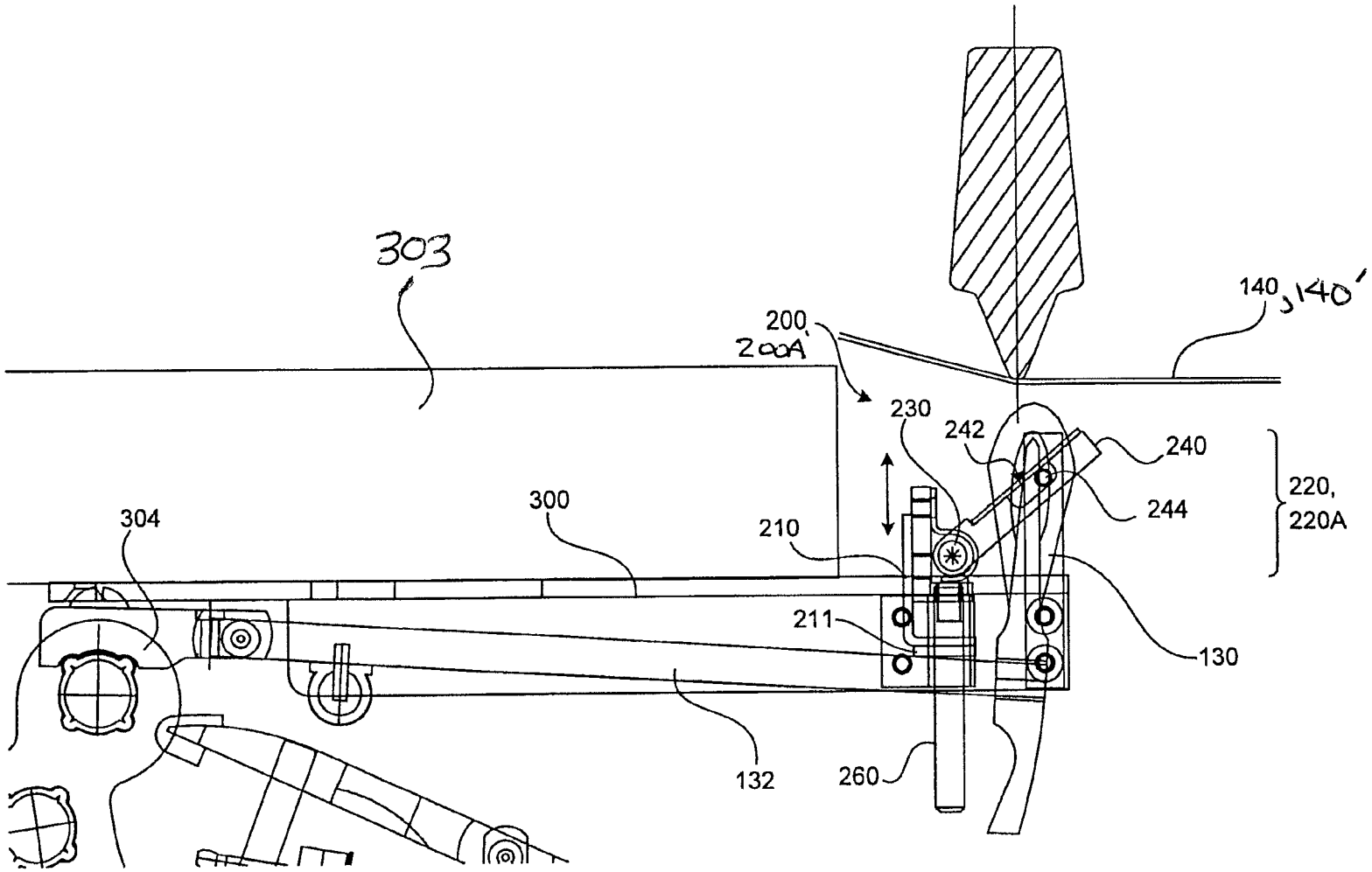
FIG. 13 is a side view of a hammer stopper system in a silent mode/stopper position.

Referring also to FIGS. 6 and 6A (from which the action parts, hammer stopper rails, and hammer stopper assembly linkages of the upright piano are omitted for greater visibility), FIGS. 7 and 7A and FIGS. 8 and 8A (from which the action parts are omitted for greater visibility), the hammer stopper rail 210, 210' is mounted very securely upon mounting brackets 300 with linear linkage hardware assemblies 302 that are all exceptionally robust and strong in the front-to-back direction.

The stopper rail system 200, 200B of the present disclosure includes an additional mounting bracket 300' and two additional sets of linkage hardware 302', 302" in the interior of the scale (e.g., between notes 26 and 27), in the region of the "the bass-treble break" or "the break" 213. This is in addition to the standard mounting brackets 300, each with a single set of linkage hardware 302, present at the beginning (note 1) and at the end (note 88) of the piano scale. In contrast, traditional stopper rail systems have mounting brackets only at note 1 and at note 88, with no additional mounting bracket at the interior of the scale. Furthermore, the mounting brackets 300 supporting the stopper rail segments 210, 210' are associated with linkage hardware assemblies 302, consisting of adjustment screw 500 extending from threaded engagement (at screw end 508) with the stopper rail 210, 210' and plastic locknut 510 mounted thereto, to axially fixed, rotational engagement (at screw head 502) with adjustment pivot block 504, attached at pivot fulcrum connection 503 (FIGS. 7A, 8*a*, and 18) with shaft hanger block 506 secured to drive shaft 230.

The increased strength of the hammer stopper rail assembly mounting system 200B of this disclosure, including especially the mounting brackets 300 and the linkage hardware assemblies 302, results in more stationary stopper rail positioning. Even when the stopper rails 210, 210' of this disclosure are struck repeatedly by up to 20 hammers at a time (e.g., in a typical 4-hand performance), the stopper rails barely move, because the mounting system is so strong; and because the stopper rails barely move when struck, the stopper rails can be positioned relatively closer to the string plane. This permits relatively reduced action regulation compromises, which, in turn, results in a better feeling action and a piano that is easier to play well.

In addition, the solidity of the stopper rails and the mounting system of the hammer stopper rail assembly system 200B of the present disclosure reduces the amount of energy is that absorbed by the stopper rail system when struck by the piano hammers 130. Instead, the piano hammers 130 are caused to bounce back at nearly their original velocity, transmitting an amount of energy back into the piano action 120 and the keys 110, to replicate the reflective quality of an original acoustic piano action in which hammers 130 rebound from tensioned strings 140, 140'.

Figure 14:
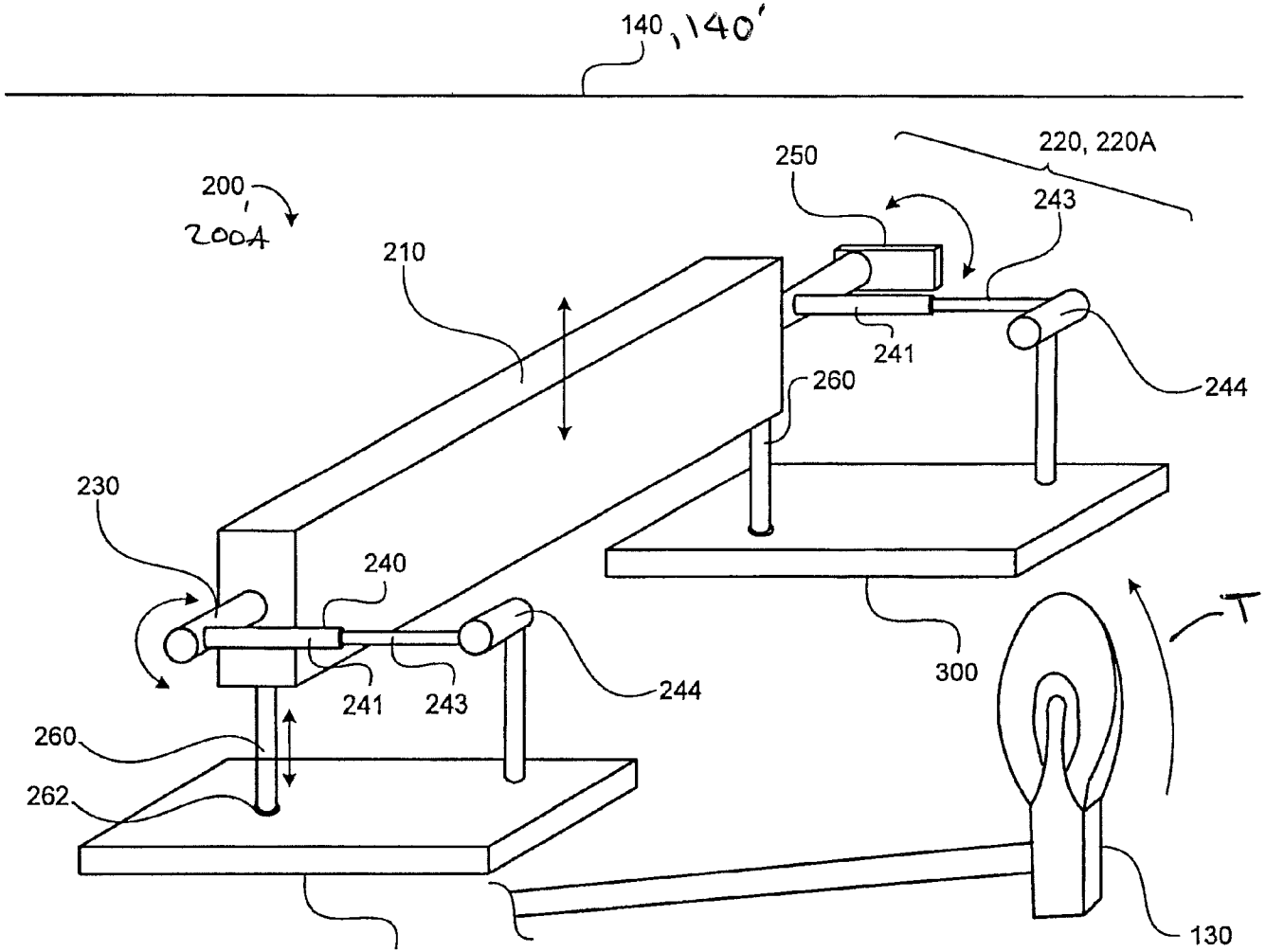
FIG. 14 is a perspective view of a hammer stopper system of the disclosure for a grand piano.
Figure 15:
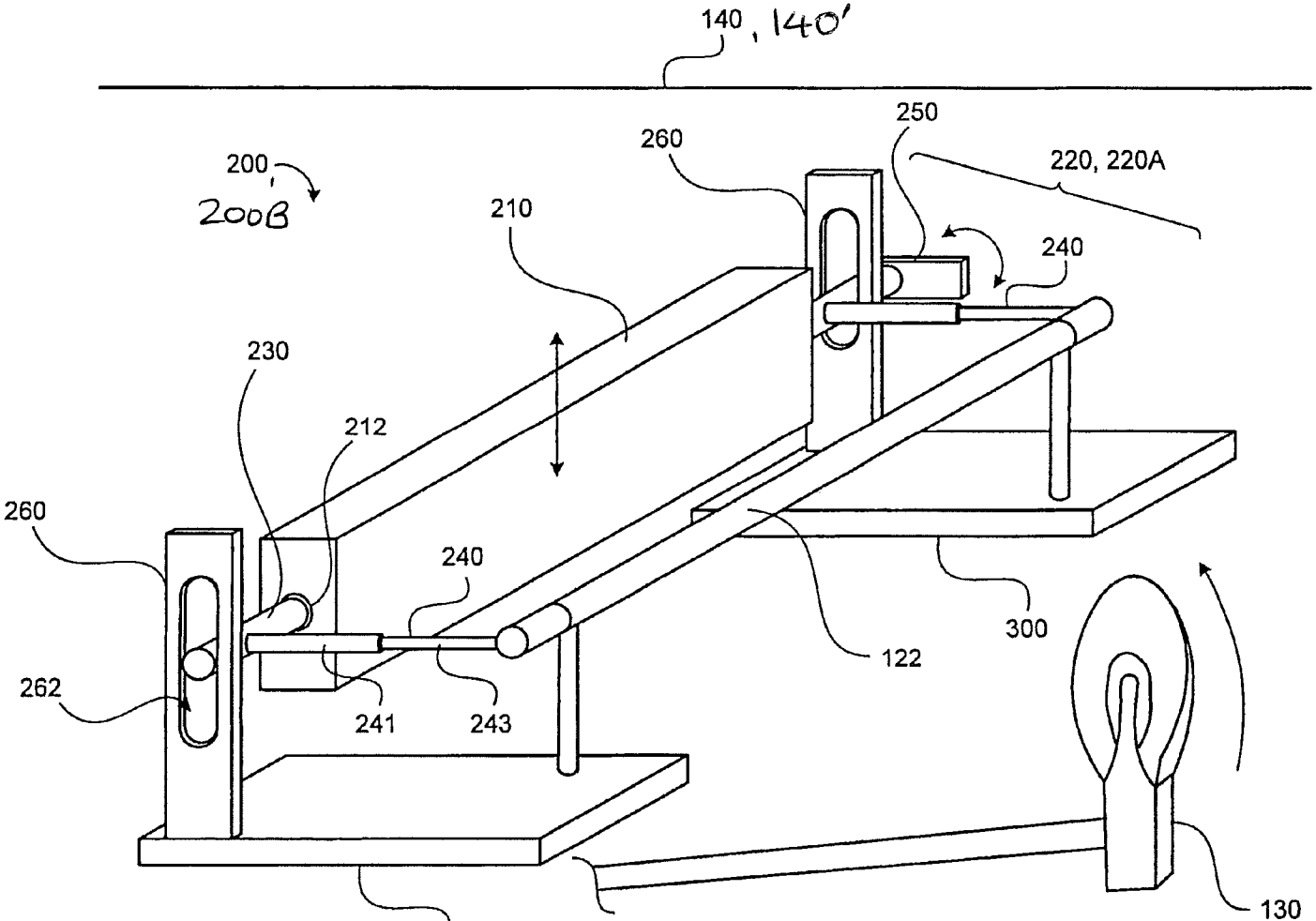
FIG. 15 is a perspective view of a hammer stopper system of the disclosure for a grand piano.
Figure 16:
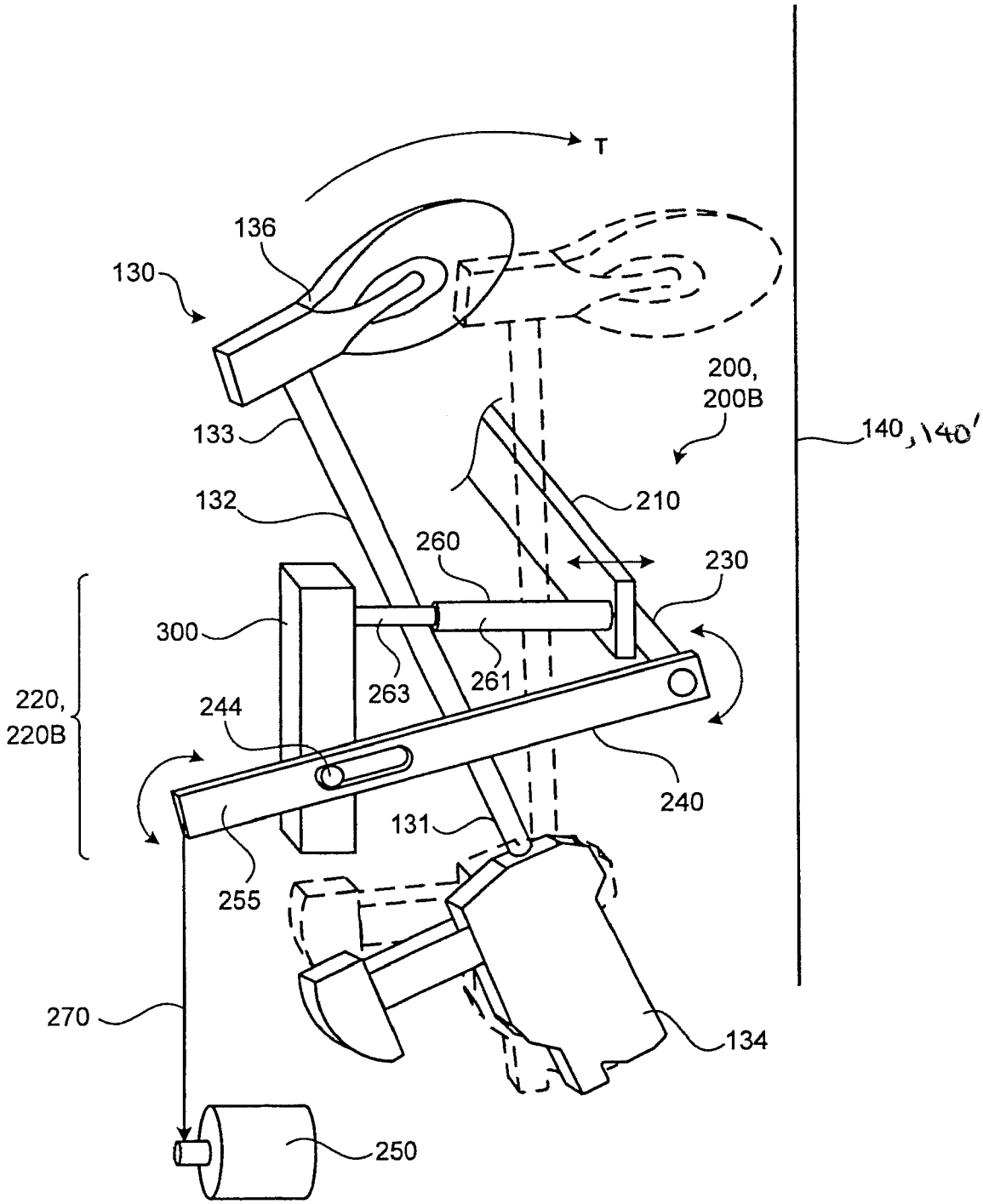
FIG. 16 is a perspective view of a hammer stopper system of the disclosure for an upright piano.

In some implementations, e.g. for a grand piano, as shown in FIGS. 4 and 9-15, the drive arm 240 defines a guide way 242 (e.g., slot or groove) configured to receive the drive arm fulcrum 244. Rotation of the drive shaft 230 in the clockwise or counter-clockwise direction causes the drive arm 240 to pivot and slide on the drive arm fulcrum 244 to move the stopper rail 210 between its first and second positions. In some implementations, as shown in FIGS. 14 and 15, the drive arm 240 includes first and second portions 241, 243 slidably engaging one another (e.g., telescopically). The first drive arm portion 241 is attached to the drive shaft 230 and the second drive arm portion 243 is pivotally attached to the drive arm fulcrum 244. Rotation of the drive shaft 230 in the clockwise or counter-clockwise direction causes the drive arm 240 to pivot on and telescope to and from the drive arm fulcrum 244 to move the stopper rail 210 between its first and second positions.

In the examples shown in FIGS. 9-14, the travel guide 260 is configured as a guide shaft 260 attached to the stopper rail 210 and received through a guide way 262 (e.g., aperture or groove) defined by the support member with mounting bracket 300. Similarly, the guide shaft 260 may be attached to the support member 300 and received through a guide way 262 defined by the stopper rail 210. In the example shown in FIG. 15, the travel guide 260 is attached to a support member 300 and defines a guide way 262 (e.g., slot or groove) for receiving the drive shaft 230, which is disposed on or through the stopper rail 210. The travel guide 260 allows rotation of the drive shaft 230 and is disposed at each end of the stopper rail 210 for guiding movement of the stopper rail 210. In the example shown in FIG. 11, the travel guide 260 includes a spring 266 for biasing the stopper rail 210 toward its second position for silent play.

FIGS. 3, 16, 18, and 19 illustrate implementations of a hammer stopper system 200, 200B for an upright piano 100B. The hammer stopper system 200B includes a stopper rail 210 disposed between the hammers 130 and the strings 140, and a rail actuator assembly 220B configured to move the stopper rail 210 between a first position, allowing unobstructed movement of the hammers 130, and a second position stopper at least one hammer 130 from striking its corresponding string(s) 140. The rail actuator assembly 220B moves the stopper rail 210 to the first position for acoustic play and to the second position for silent play. In the example shown in FIG. 16, the rail actuator assembly 220B includes a drive shaft 230 disposed along the stopper rail 210. The drive shaft 230 may be a rigid shaft (e.g., bar stock) or a flexible shaft, which transmits rotation and torque while remaining flexible to bend along any curves of the stopper rail 210. In some examples, the drive shaft 230 is routed through a channel 212 defined by the stopper rail 210. The rail actuator assembly 220 includes at least one drive arm 240 attached to the drive shaft 230 and slidably coupled to a support member or mounting bracket 300. Rotation of the drive shaft 230 causes rotation of the drive arm 240 which engages a drive arm fulcrum 244 to move the stopper rail 210 between its first and second positions. The drive arm fulcrum 244 may be disposed on a support member 300 (e.g., bracket). The rail actuator assembly 220B includes a drive arm rotator 255 configured to pivot the drive arm 240 with respect to the drive fulcrum 244.

The rail actuator assembly 220B includes one or more travel guides 260 configured to guide movement of the stopper rail 210 along a travel path between its first and second positions. As with the grand piano system, the travel path may be a substantially linear or non-linear (e.g., parabolic). In the example shown in FIG. 16, the travel guide 260 includes first and second portions 261, 263 slidably engaging one another (e.g., telescopically) and providing a substantially linear travel path for the stopper rail 210. The first travel guide portion 261 is attached to the stopper rail 210 and the second travel guide portion 263 is attached to the support member 300.

Figure 17:
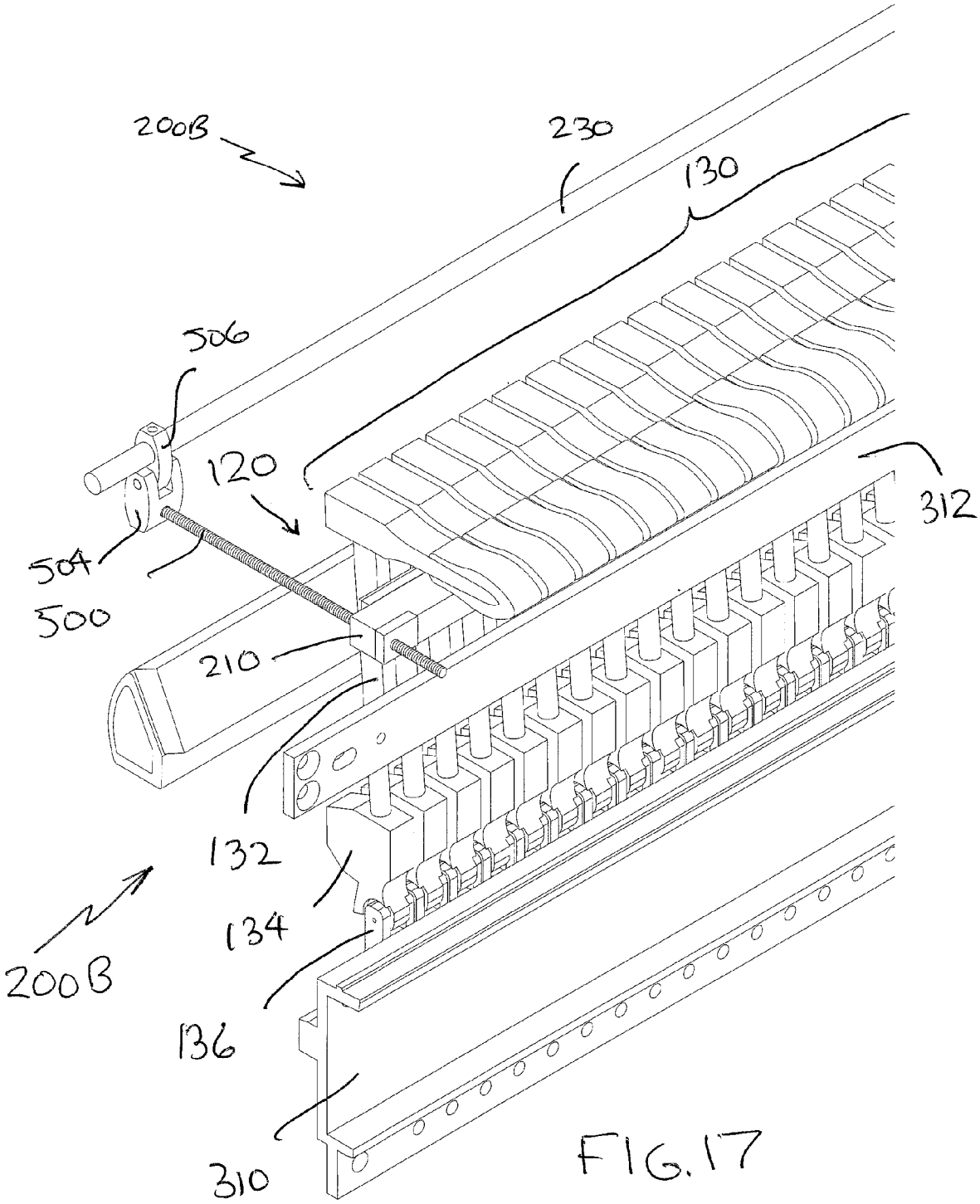
FIG. 17 is a perspective view of a hammer stopper assembly of the disclosure for an upright piano.
Figure 18:
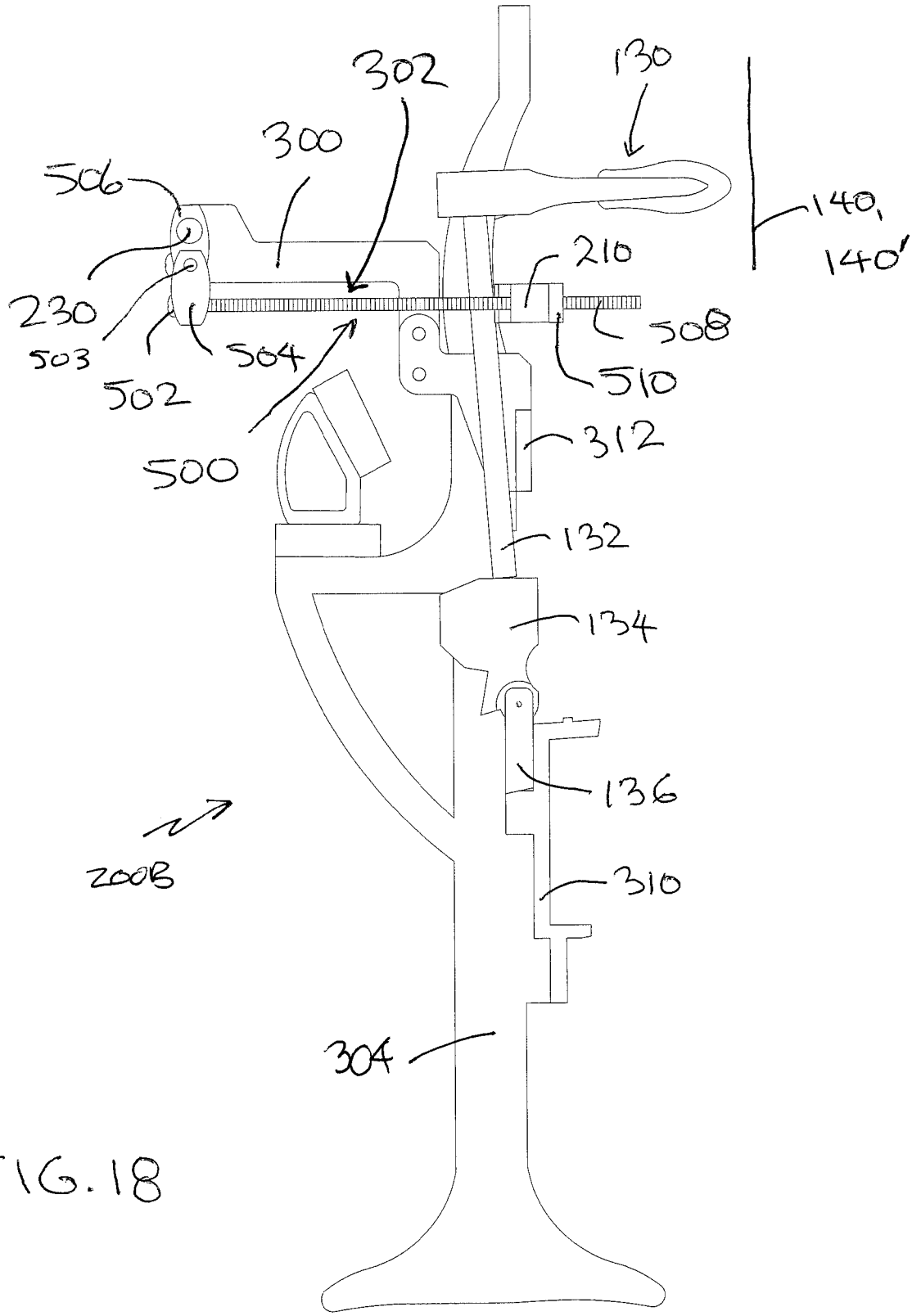
FIG. 18 is a side view of an adjustable stopper rail mounting bracket for the hammer stopper assembly of FIG. 17 (including the action bracket, which is not shown in FIG. 17).

Referring to FIGS. 17 and 18, a stopper rail assembly of the present disclosure for an upright piano 100B is shown. In particular, FIG. 17 is a perspective view of the hammer stopper assembly 200B with the following elements removed for improved visibility: action bracket (304, in FIG. 18), damper lever assemblies, whippen assemblies, the portion of the hammer butt assemblies below the wooden butt molding, and mounting bracket for stopper rail. In FIG. 17, a set of piano hammers 130 are seen mounted on hammer shanks 132 extending from butts 134 mounted from hammer flanges 136 on the main action rail 310, e.g., an aluminum extrusion. Damper stopper rail 312, seen also in FIG. 18, is an aluminum bar covered with felt, which also serves as a cross-bar on which the mounting bracket 300 is hung. Referring now also to FIG. 18, the mounting brackets 300 supporting the opposite ends of the stopper rail 210 (indirectly via the linkage assemblies, and in the horizontal direction) are associated with linkage hardware assemblies 302, consisting of adjustment screw 500 extending from threaded engagement (at screw end 508) with the stopper rail 210, 210' and plastic locknut 510 mounted thereto, to axially fixed, rotational engagement (at screw head 502) with adjustment pivot block 504, attached as pivot fulcrum connection 503 with shaft hanger block 506 secured to drive shaft 230. This arrangement provides end-sectional adjustment screws 500 accessible at the front of the piano action 120, at each end of the stopper rail 210, 210'. The screws, which permit adjustment of the position of the stopper rail 210, 210' relative to the string plane 140, 140' are mounted for axial adjusting motion in the stopper rail direction. The head 502 of each screw 500 is exposed at the front of the piano action 120 at the adjustment pivot block 504, which extends from the shaft hanger block 506 below the drive shaft 230 on mounting bracket 300. The screw head 502 is locked axially in the adjustment pivot block 504, but not locked rotationally. When the screw head 502 is turned, e.g. by the blade of a screwdriver (not shown) aligned generally axially with the screw 500, threaded screw body 508 rotates in tapped hole in the steel stopper rail 210, 210' and nylon inset 510 (similar to a locknut) mounted on the back side of the stopper rail. In another implementation, the nylon insert or locknut has the form of a plastic cylinder 510' (seen in dashed line in FIG. 7A) press fit into a vertical cylindrical holes formed in the top surface of stopper bars 210, 210'. As seen in the drawings, the screw 500 is disposed horizontally, with the adjustment screw head 502 thus being easily accessible with conventional tools. Adjusting rotation of the screw 500 causes a directly responsive movement of the stopper rail 210, either forward or backward, depending on the direction of screw rotation, which makes precise adjustment of the position of the stopper bar 210, 210' relative to the plane of the piano strings 140, 140' as the horizontal screw 500 is turned by fractions of a turn, and since the locknut 510 is secured to the stopper rail 210, 210', there is no late or accidental movement of the adjusted position. By way of example, with the stopper rail 210, 210' in stopper (silent play) position, a technician may use one hand to hold a piano hammer 130 against the stopper rail 210, and use the other hand to turn a screwdriver in engagement with the screw head 502. Adjustment feedback is instantaneous, i.e., the technician can watch as spacing between the held piano hammer 130 and the strings 140, 140' change while the adjustment screw 500 is turned. As mentioned above, the nylon insert or locknut 510 is built into the stopper rail 210, 210', so no additional tightening or loosening is necessary. Feedback is instantaneous, and subsequent tightening or adjustment is not required. As a result, the ease of adjustment of the hammer stopper rail assembly system 200B of the present disclosure permits a more accurate setting of the stopper distance from the string plane, and as the adjustment is being made, the piano action 120 remains functional, and the stopper distance can be accurately determined.

This arrangement differs from other piano adjustment systems, where adjustment screws may be accessible, but they are disposed vertically and accessed only indirectly, which makes it difficult to adjust the stopper rail brackets. For example, in one known implementation, three vertical screws must be loosened to permit re-positioning of an L-shaped bracket, then the vertical screws must be retightened while taking care that the L-bracket does not move before the screws are secure. The positioning must then be checked again, and the process repeated as necessary.

Figure 20:
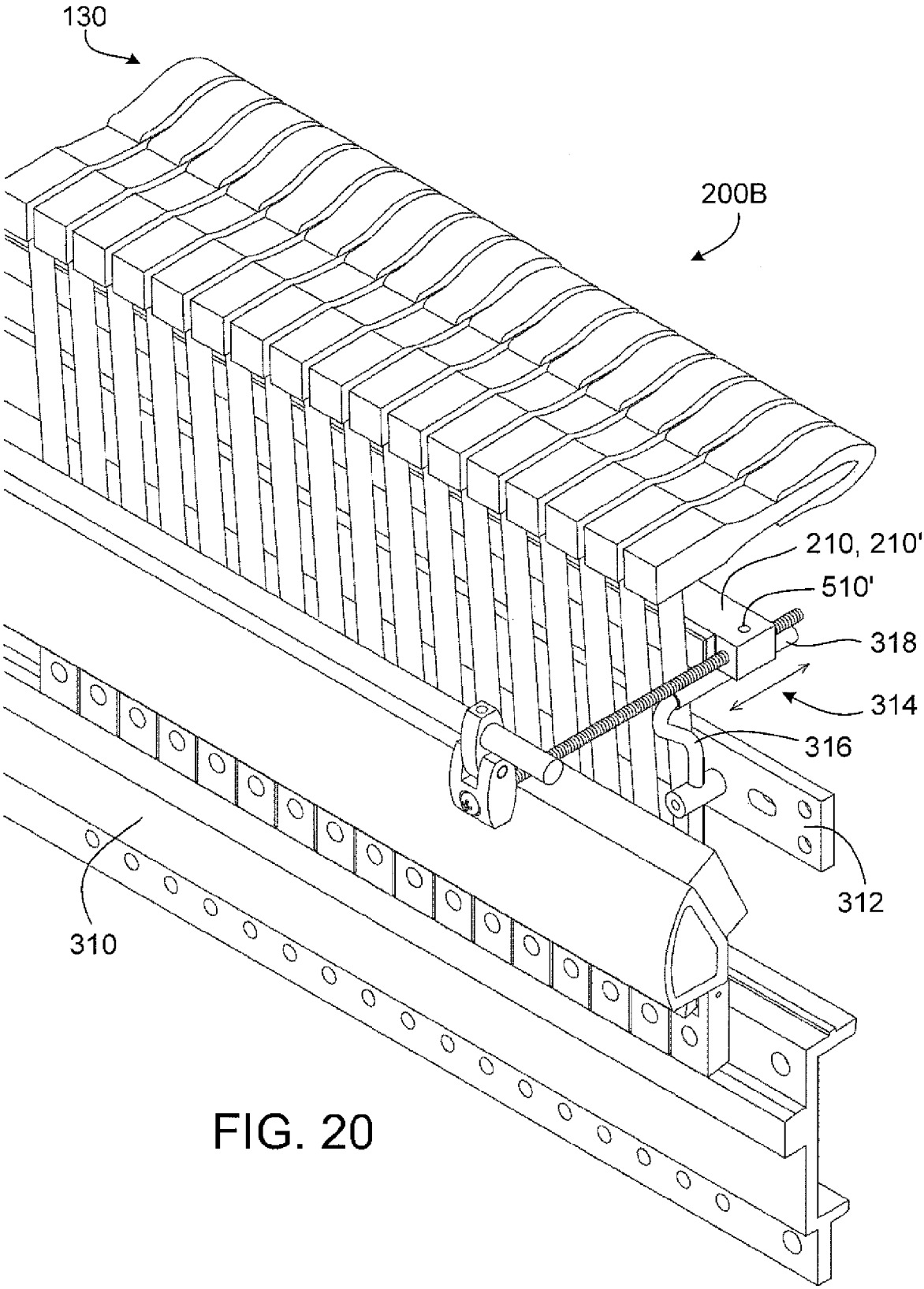
FIG. 20 is a perspective view of another hammer stopper assembly of the disclosure for an upright piano.
Figure 20B:
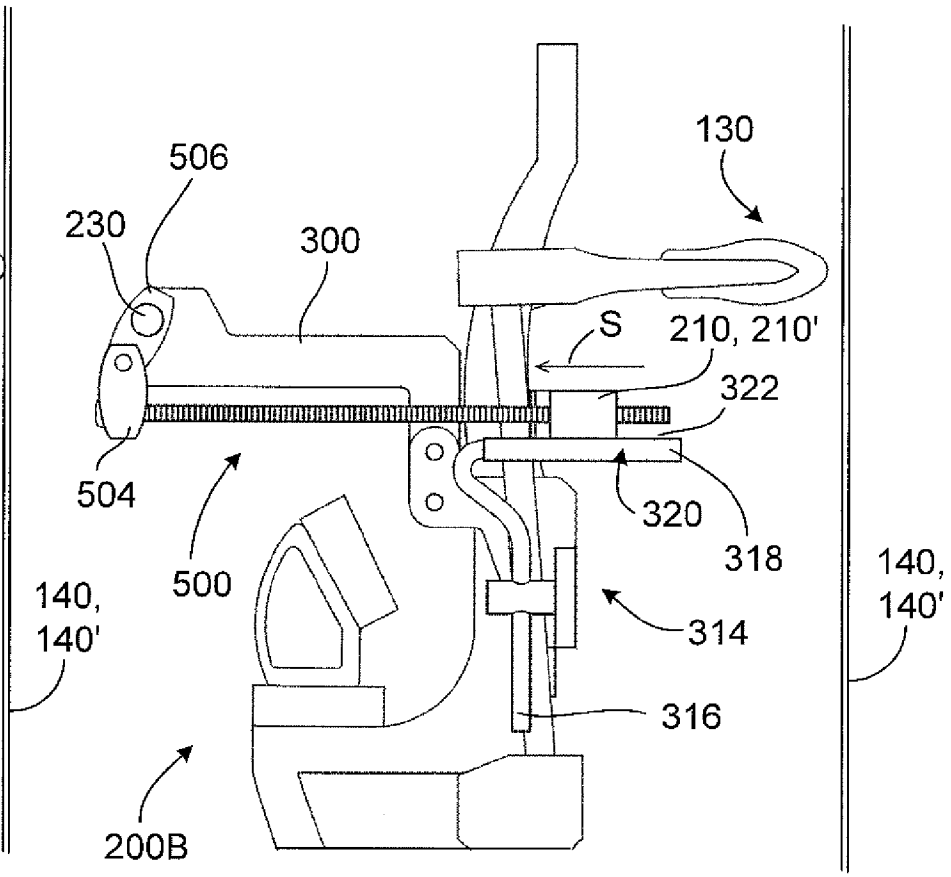
FIGS. 20A and 20B are side views of an adjustable stopper rail mounting bracket for the hammer stopper assembly of FIG. 20 with the stopper bar in a forward (non-stopper) position on the travel guide and in a rearward (stopper) position on the travel guide, respectively.
Figure 20A:
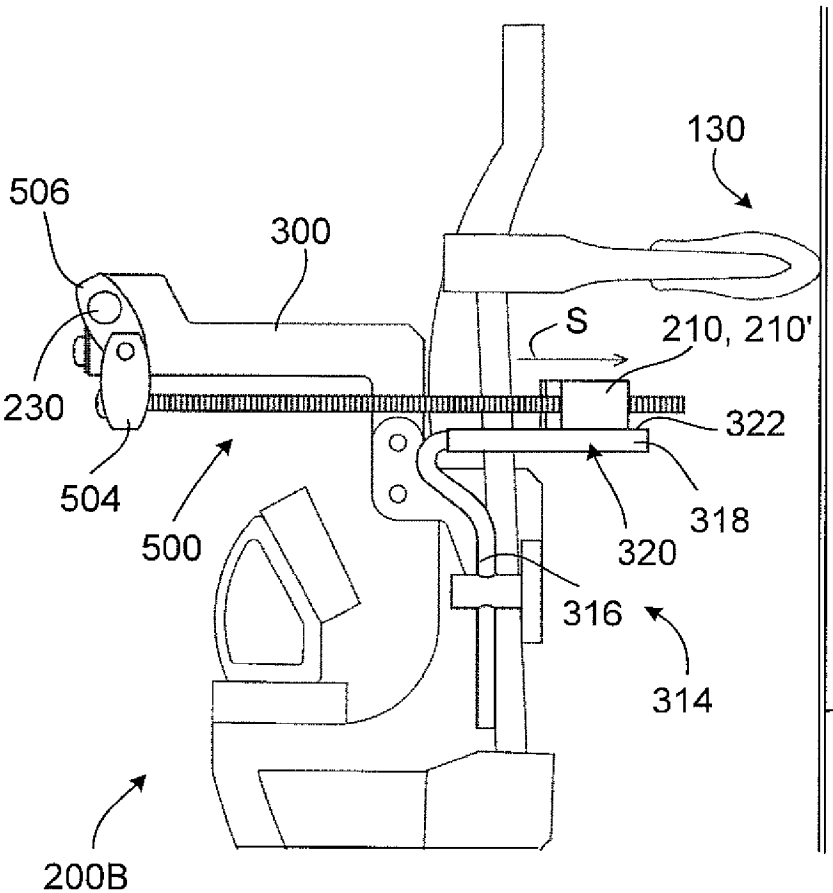

Referring also to FIGS. 20, 20A, and 20B, in another implementation of the hammer stopper system of FIGS. 17 and 18, a travel guide 314 for the hammer stopper rail 210, 210' is adjustably mounted to the damper stop rail 312 in the hammer stopper system 200B for the upright piano 100B. The travel guide 314 has the form of a bent wire body 316 covered by flexible tubing 318 of low friction, wear resistant material, e.g. polyethylene. The upper end portion 320 of the body 316 provides a generally horizontal surface 322 that supports the hammer stopper bar 210, 210'. The lower surface of the stopper bar, disposed in engagement with the surface 322, is preferably covered with a low friction material, e.g. felt, and slides forward and backward (arrow S) on the plastic covered body 316 of the travel guide wire 314, e.g. as the hammer stopper rail 210, 210' is moved forward (closer to the strings 140, 140') towards a non-blocking position (FIG. 20A) and backward (away from the strings 140, 140') towards a blocking position (FIG. 20B). As in FIG. 7A, the locknut has the form of a plastic cylinder 510' press fit into a vertical cylindrical holes formed in the top surface of stopper bar 210, 210'.

In another implementation, mechanical properties, e.g., mass, stiffness, energy absorption, etc. of the piano hammer stopper rail system of the present disclosure are intentionally varied across the piano, in order to achieve desired piano performance characteristics across the full range of piano keys. The range of desired mechanical properties is achieved by intentional choices of, e.g., materials, size, shape, fasteners, etc. In a standard acoustic piano, hard felt hammers strike steel and copper/steel wire strings. In a hybrid piano, in silent mode, the hammer shanks strike the hammer stopper bar assembly instead of the hammers striking the piano strings. Differences between the materials that are struck, and between the rotational positions of the hammer and shank assembly when the strike occurs, tend to make the "action touch", i.e. the feel of the action to the pianist's fingers, different.

An objective of the hammer stopper rail system of the present disclosure is to cause the difference in feel to the pianist to be as small as possible. The elements contributing to reaching this objective include, e.g., the two piece stopper rail, the massive stopper rail, the robust mounting structure, etc. Since piano string length and diameter, and hammer size and weight, vary from bass to treble, the "action touch" also varies from bass to treble. In the hammer stopper rail system of the present disclosure, some mechanical properties are intentionally designed to vary from bass to treble, in order to best match the mechanical properties of the acoustic piano action played in acoustic mode.

Figure 19:
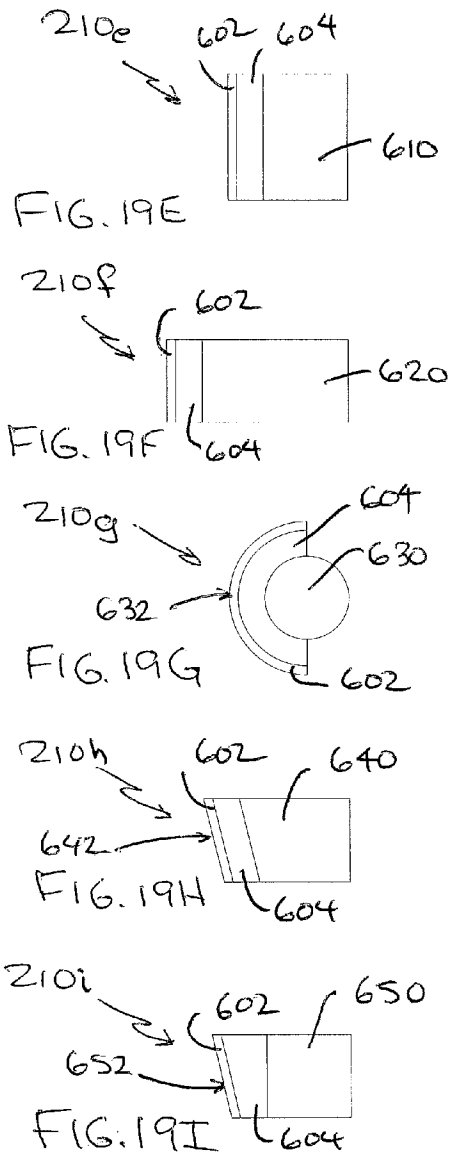
FIG. 19 is a somewhat diagrammatic side view of a piano hammer in engagement with a first stopper rail arrangement in a hammer stopper rail assembly of the disclosure, e.g. for an upright piano, and FIGS. 19A through 19I showing side section views of other examples of stopper rail arrangements for the hammer stopper rail assembly of the disclosure.
Figure 19:
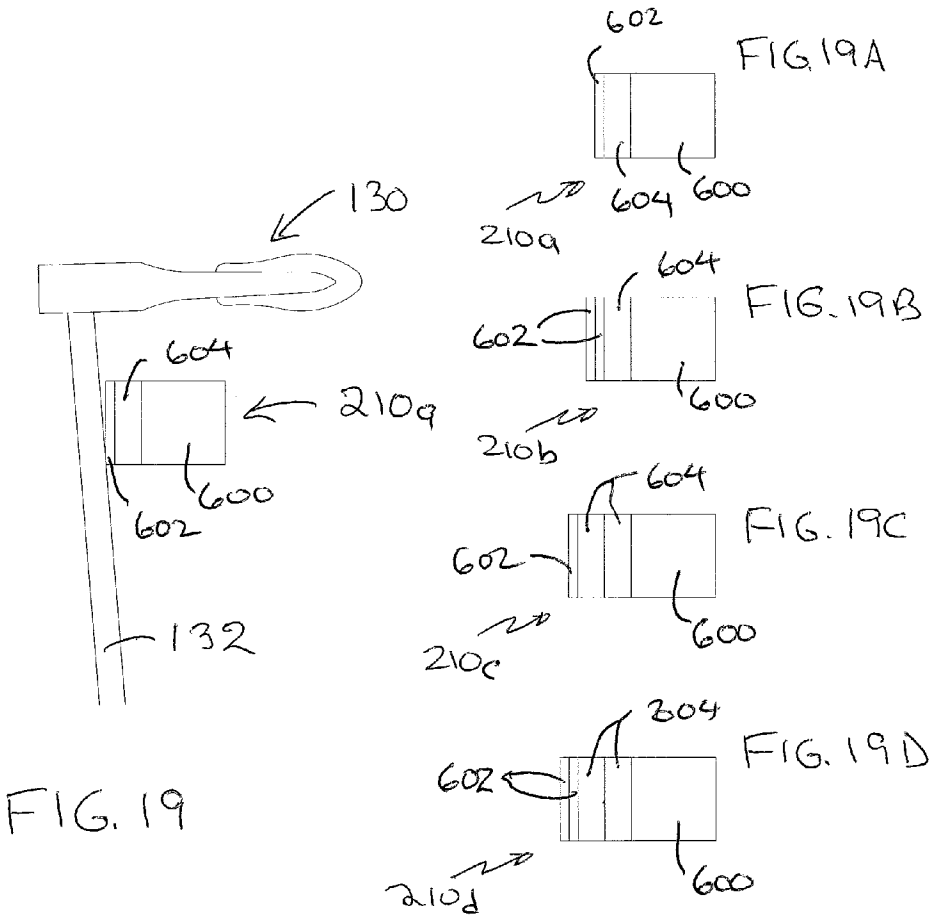

Referring to FIG. 19 and to FIGS. 19A through 19I, various, but non-exhaustive, examples of constructions and arrangements of stopper rail cross sections are shown, including variations in cushioning characteristics, materials, mechanical properties, dimensions, arrangements, etc., across range of the piano key positions. For example, in FIGS. 19 and 19A, a stopper rail 210*a* has a metal rail body 600, e.g. steel or other suitable metal, plastic, or other strong, rigid material, faced with a relatively thin layer 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed therebetween. In FIG. 19B, a stopper rail 210*b* has a metal rail body 600, e.g. steel or other suitable metal, plastic, or other strong, rigid material, faced with two relatively thin layers 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed between the thin layers 602 and the rail body 600. In FIG. 19C, a stopper rail 210*c* has a metal rail body 600, e.g. steel or other suitable metal, plastic, or other strong, rigid material, faced with a relatively thin layer 602 formed, e.g. of suitable sound and/or force absorbing material, e.g. any of felt, cloth, microfiber, leather, thin foam, etc., with two relatively thicker layers of suitable sound and/or force absorbing material 604, e.g. any of relatively dense or softer foam, relatively dense or softer felt, etc., disposed between the thin layer 602 and the rail body 600. In FIG. 19D, a stopper rail 210*d* has a metal rail body 600, e.g. steel or other suitable metal, plastic, or other strong, rigid material, faced with two relatively thin layers 602 formed, e.g. of suitable sound and/or force absorbing material, e.g. any of felt, cloth, microfiber, leather, thin foam, etc., with two relatively thicker layers of suitable sound and/or force absorbing material 604, e.g. any of relatively dense or softer foam, relatively dense or softer felt, etc., disposed between the thin layers 602 and the rail body 600. In FIG. 19E, a stopper rail 210*e* has a metal rail body 610, e.g. steel or other suitable metal, plastic, or other strong, rigid material, of different dimensions, faced with a relatively thin layer 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed between the thin layer 602 and the rail body 610. In FIG. 19F, a stopper rail 210*f* has a metal rail body 620, e.g. steel or other suitable metal, plastic, or other strong, rigid material, of other different dimensions, faced with a relatively thin layer 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed between the thin layer 602 and the rail body 620. In FIG. 19G, a stopper rail 210*g* has a cylindrical metal rail body 610, e.g. steel or other suitable metal, plastic, or other strong, rigid material, of different dimensions, faced with a relatively thin, curved layer 602 formed, e.g. of suitable sound and/or force absorbing material, e.g. any of felt, cloth, microfiber, leather, thin foam, etc., with a relatively thicker, curved layer of suitable sound and/or force absorbing material 604, e.g. any of relatively dense or softer foam, relatively dense or softer felt, etc., disposed between the thin layer 602 and the rail body 630, forming a curved stopper surface 632. In FIG. 19H, a stopper rail 210*h* has a metal rail body 640, e.g. steel or other suitable metal, plastic, or other strong, rigid material, of different dimensions and an angled front (stopping) surface, faced with a relatively thin layer 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed between the thin layer 602 and the rail body 640, the layers 602 and 604 having relatively uniform thickness, forming an angled stopper surface 642. In FIG. 19I, a stopper rail 210*i* has a metal rail body 650, e.g. steel or other suitable metal, plastic, or other strong, rigid material, faced with a relatively thin layer 602 formed, e.g. of suitable sound and/or force absorbing material, e.g. any of felt, cloth, microfiber, leather, thin foam, etc., with a relatively thicker layer of suitable sound and/or force absorbing material 604, e.g. any of relatively dense or softer foam, relatively dense or softer felt, etc., disposed between the thin layer 602 and the rail body 650. The layer 602 in this implementation has relatively uniform thickness, while layer 604 has tapered thickness, with the larger thickness at the upper edge, forming an angled stopper surface 652.

Many other implementations are also possible for the purpose of varying and/or customizing the performance characteristic of the hammer stopper rail assembly system 100, 100A, 100B across the range of the piano keys. For example, mounting bracket size, shape, material, quantity and/or location; linkage design; stopper rail location; mounting bracket location; etc., can be varied across the range of the piano in order to achieve the desired touch characteristics of the hammer stopper rail system in an acoustic piano action. In one implementation, the bass stopper rail 210 may have a relatively thicker layer of suitable sound and/or force absorbing material, e.g. any of relatively dense or softer foam, relatively dense or softer felt, etc., applied over the stopper surface of a metal rail body, while the treble stopper rail 210' may a relatively thin layer formed of thin woven felt, with a relatively thicker layer of suitable sound and/or force absorbing material, e.g. thick dense foam disposed between the thin layer and the metal rail body of rectangular cross section (see, e.g., FIGS. 19 and 19A, as described above). In other implementations, construction of the stopper rails 210, 210' may be changed at the middle, or other interval, of one or both of bass segment (201A/201B) and the treble segment (203A/203B).

These intentional variations across the 88 piano notes allow a hybrid piano to have touch characteristics that mimic, as closely as possible, the touch characteristics of an acoustic piano, across the entire piano.

Referring again to FIGS. 1 and 3, in some implementations, the piano 100A, 100B includes a mode selection switch 150 in communication with the rail actuator assembly 220, 220A, 220B (e.g., in communication with the shaft rotator 250 or the drive arm rotator 255). A user may toggle the mode switch 150 to alter the play mode between acoustic play and silent play, and the drive shaft 230 is rotated to the corresponding position of the play mode. In some implementations, the mode selection switch 150 is coupled to a wire or linkage 270 coupled to the rail actuator assembly 220 (e.g., via the shaft rotator 250 or the drive arm rotator 255). In other implementations, the mode selection switch 150 may be housed by a controller unit 400 (FIGS. 1 and 3) disposed on the piano 100A, 100B. The controller 400 may include circuitry that controls switching between play modes (e.g. via the rail actuator assembly 220, 220A, 220B), storing play information (e.g. MIDI files), electronic play calibration, tone adjustment, and trouble shooting, inter alia. The controller 400 may be in communication with the drive shaft rotator 250 or the drive arm rotator 255 actuating the rail actuator assembly 220.

Figure 21:
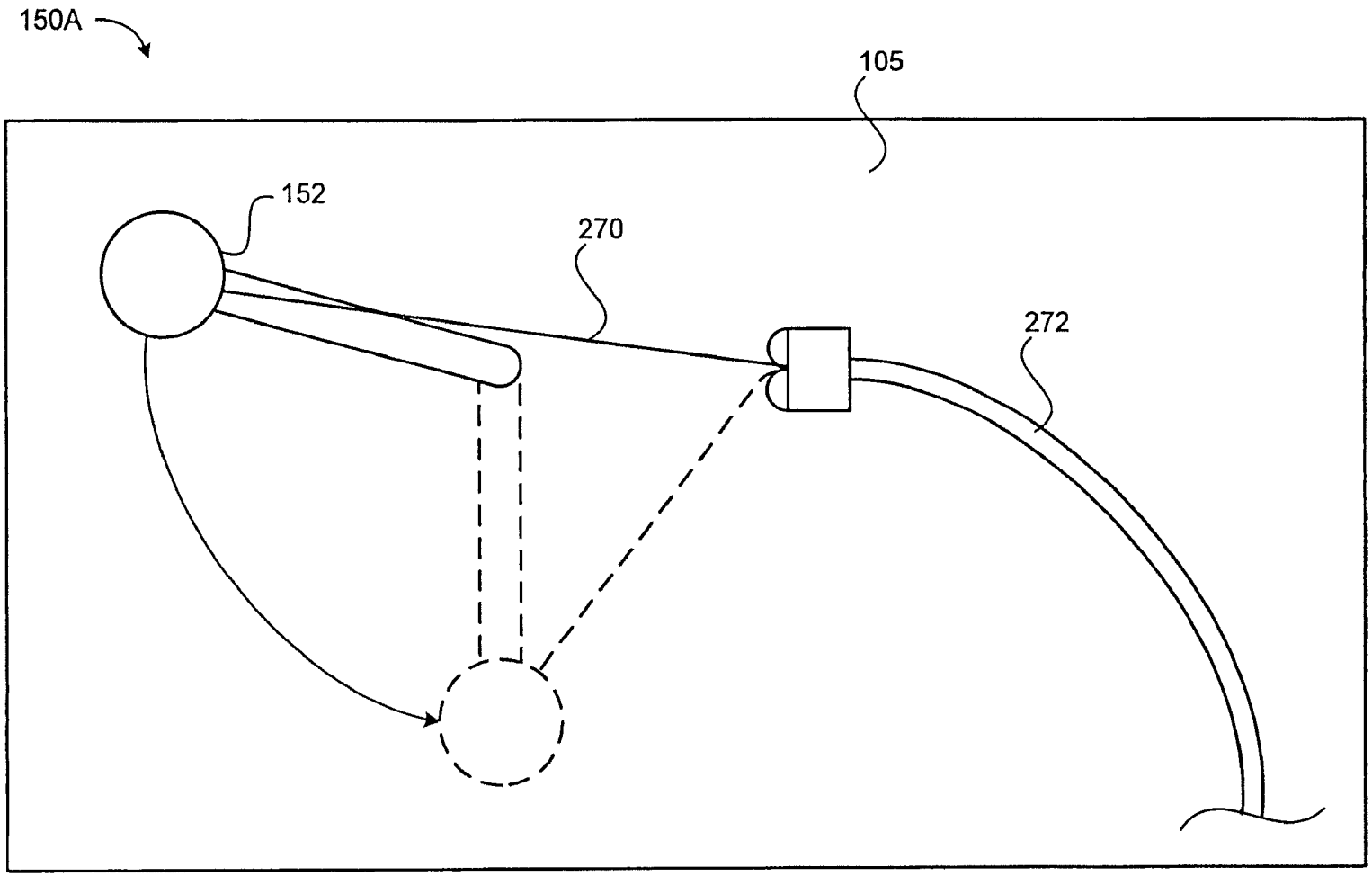
FIG. 21 is a side view of a mode selection switch, e.g. for a grand piano.

The piano 100A, 100B may also include a mode selection switch 150A, an example of which is shown in FIG. 21, disposed on a portion of a piano case 105 of the piano 100A, 100B. For example, the mode selection switch 150A may be located on the piano case 105 below the keys 110 (e.g., on a vertical or horizontal panel). The mode selection switch 150A includes a handle 152 pivotable between first and second positions. The wire 270 is attached to the handle 152 and guided through a sheath 272 to the shaft rotator 250. In its first position, the mode selection switch 150A causes the rail actuator assembly 220 of the hammer stopper system 200 to hold the stopper rail 210 in its first position allowing unobstructed movement of piano hammers 130. In its second position, the mode selection switch 150A causes the rail actuator assembly 220 to hold the stopper rail 210 in its second position stopper at least one piano hammer 130 from striking any corresponding strings 140. The handle 152 may be releasably held in its first and second positions be a spring, magnet, releasable fastener (e.g., hook and loop fasteners), etc. In the example of a spring, a spring 266 may be attached to the handle and/or the rail actuator assembly 220. In some examples, the handle 152 may be releasably held in its first and second positions by a detent, groove, or feature defined by the piano case 105 or a bracket holding the handle 152.

In some implementations, the silent play mode is engaged by pressing a mode selection pedal 160 (e.g., by pressing the pedal 160 downward and then rotating it laterally to a lockably engaged position to hold the silent play mode). The mode selection pedal 160 is coupled to a cable or linkage 270 coupled to the rail actuator assembly 220 (e.g., via the shaft rotator 250 or the drive arm rotator 255). In some cases, the mode selection pedal 160 engages the mode selection switch 150 when moved to its engaged position. The mode selection pedal 160 may be held in its engaged position, e.g., by a magnet, detent in a piano casing, a bracket, etc.

A number of implementations have been described. Nevertheless, it will be understood that various modifications may be made without departing from the spirit and scope of the disclosure. For example, referring to FIG. 4, the spring 266 may instead be disposed, e.g. between the support member 300 and the stopper rail 210, for biasing the stopper rail 210 toward its first position for acoustic play, or an extension spring may instead, or also, be employed. Accordingly, other implementations are within the scope of the following claims.

What is claimed is:

1. A piano hammer stopper system comprising:

a stopper rail set comprising at least a first stopper rail member and a second stopper rail member, each movable between respective first positions, allowing unobstructed movement of associated piano hammers, and respective second positions, stopping at least one associated piano hammer from striking any corresponding string;

at least one drive shaft rotatably coupled to one or both of said first and second stopper rail members of the stopper rail set;

a drive arm attached to the at least one drive shaft and engaging a drive fulcrum; and at least one travel guide directing movement of one or both of said first and second stopper rail members of the stopper rail set between respective first and second positions;

wherein rotation of the at least one drive shaft rotates the drive arm to engage the drive fulcrum for moving one or both of said first and second stopper rail members of the stopper rail set between its respective first and second positions.

2. The piano hammer stopper system of claim 1, wherein said at least one drive shaft is coupled to both said first and second stopper rail members of the stopper rail set, and both first and second stopper rail members are moved in unison between respective first and second stopper positions.

3. The piano hammer stopper system of claim 1, wherein said at least one drive shaft comprises:

a first drive shaft coupled to said first stopper rail member of said stopper rail set, and a second drive shaft coupled to said second stopper rail member of said stopper rail set, and said first and second stopper rail members are moved independently between respective first and second stopper positions.

4. The piano hammer stopper system of claim 1, wherein the drive arm defines a slot configured to the receive the drive fulcrum, the drive arm pivoting about and sliding with respect to the received drive fulcrum.

5. The piano hammer stopper system of claim 1, wherein the drive arm comprises first and second drive arm portions slidably engaging one another, the first drive arm portion attached to the stopper rail, and the second drive arm portion pivotally coupled to the drive fulcrum.

6. The piano hammer stopper system of claim 1, wherein the at least one travel guide comprises at least one guide shaft received by a guide way, the at least one guide shaft attached to at least one of the said first and second stopper rails of said stopper rail set and at least one support member of the hammer stopper system.

7. The piano hammer stopper system of claim 1, wherein the at least one travel guide defines a guide way configured to receive the at least one drive shaft.

8. The piano hammer stopper system of claim 1, wherein at least one of said first and second stopper rail members of said the stopper rail set is biased toward one of its respective first and second positions.

9. The piano hammer stopper system of claim 1, wherein the at least one drive shaft is flexible for following the general shape of the stopper rail set.

10. The piano hammer stopper system of claim 1, further comprising a shaft rotator coupled to the at least one drive shaft for rotating the at least one drive shaft.

11. The piano hammer stopper system of claim 10, wherein the shaft rotator comprises a lever defining an aperture for a receiving a pivot, rotation of the lever about the pivot moving the at least one drive shaft vertically with respect to the pivot and rotating the drive shaft with respect to the stopper rail set.

12. The piano hammer stopper system of claim 1, further comprising an arm rotator coupled to the drive arm for pivoting the drive arm with respect to the drive fulcrum.

13. The piano hammer stopper system of claim 1, wherein the first and second stopper rail members are supported by robust mounting brackets and linkage hardware designed and constructed to resist deflection and/or displacement of associated first and second stopper rails members when struck by one or multiple piano hammers during silent play mode.

14. The piano hammer stopper system of claim 1, wherein first and second stopper rail members are supported at inner, opposed ends by an additional robust mounting bracket disposed therebetween, with additional linkage hardware extending between the additional mounting bracket and each of the opposed stopper rail member ends.

15. The piano hammer stopper system of claim 1, wherein the stopper rail set varies along its length in manner to cause feel of a piano key strike against a stopper rail in silent play mode to vary along the length of the stopper rail replicating variation in feel of piano key strike against strings of the piano in acoustic play mode along the length of a piano action.

16. The piano hammer stopper system of claim 1, wherein at least one of said first and second stopper rail members of said stopper rail set varies along its length in manner to cause feel of a piano key strike against a stopper rail in silent play mode to vary along the length of the stopper rail replicating variation in feel of piano key strike against strings of the piano in acoustic play mode along the length of a piano action.

17. The piano hammer stopper system of claim 15 or claim 16, wherein said stopper rail set varies along its length in one or more characteristics selected from among: dimension, shape, mass, stiffness, associated mounting bracket, linkage hardware dimensions, type, thickness, and effectiveness of padding.

18. A piano playable in an acoustic mode and a silent mode, the piano comprising:

a series of keys;

a series of key actions, each key action actuated by depression of a corresponding key;

a series of rotatable hammers, each defining a forward throw direction and having at least one corresponding string, the hammers being driven by corresponding key actions transferring forces from corresponding keys; and a hammer stopper system comprising:

a stopper rail set comprising a first stopper rail member and a second stopper rail member, each movable between a respective first position, allowing unobstructed movement of associated piano hammers, and a respective second position, stopping at least one associated piano hammer from striking any corresponding strings; and at least one rail actuator assembly coupled to at least one of the first stopper rail member and the second stopper rail member of the stopper rail set, the at least one rail actuator assembly comprising:

at least one drive shaft rotatably coupled to one or both of said first and second stopper rail members of the stopper rail set;

a drive arm attached to the at least one drive shaft and engaging a drive fulcrum; and at least one travel guide directing movement of one or both of the stopper rail members of the stopper rail set between its respective first and second position;

wherein rotation of the at least one drive shaft rotates the drive arm to engage the drive fulcrum for moving one or both of the stopper rail members of the stopper rail set between its respective first and second position.

19. The piano of claim 18, wherein said at least one drive shaft is coupled to both said first and second stopper rail members of the stopper rail set, and both first and second stopper rail members are moved in unison between respective first and second stopper positions.

20. The piano of claim 18, wherein said at least one drive shaft comprises:

a first drive shaft coupled to said first stopper rail member of said stopper rail set, and a second drive shaft coupled to said second stopper rail member of said stopper rail set, and said first and second stopper rail members are moved independently between respective first and second stopper positions.

21. The piano of claim 18, wherein the drive arm defines a slot configured to the receive the drive fulcrum, the drive arm pivoting about and sliding with respect to the received drive fulcrum.

22. The piano of claim 18, wherein the drive arm comprises first and second drive arm portions slidably engaging one another, the first drive arm portion attached to the stopper rail, and the second drive arm portion pivotally coupled to the drive fulcrum.

23. The piano of claim 18, wherein the at least one travel guide comprises at least one guide shaft received by a guide way, the at least one guide shaft attached to at least one of the first and second stopper rail members of the stopper rail set and at least one support member of the hammer stopper system.

24. The piano of claim 18, wherein the at least one travel guide defines a guide way configured to receive the at least one drive shaft.

25. The piano of claim 18, wherein at least one of the first and second stopper rail members of the stopper rail set is biased toward one of its respective first and second positions.

26. The piano of claim 18, wherein the at least one drive shaft is flexible for following the shape of the stopper rail set.

27. The piano of claim 18, further comprising a shaft rotator coupled to the drive shaft for rotating the at least one drive shaft.

28. The piano of claim 27, wherein the shaft rotator comprises a lever defining an aperture for a receiving a pivot, rotation of the lever about the pivot moving the drive shaft vertically with respect to the pivot and rotating the drive shaft with respect to the stopper rail set.

29. The piano of claim 18, further comprising an arm rotator coupled to the drive arm for pivoting the drive arm with respect to the drive fulcrum.

30. The piano of claim 18, further comprising a mode selection switch in communication with the at least one rail actuator assembly and controlling movement of the first and second stopper rail members of the stopper rail set between the respective first and second positions.

31. The piano of claim 30, wherein the mode selection switch is engaged by a pedal of the piano.

32. The piano of claim 18, further comprising a controller in communication with the at least one rail actuator assembly and controlling switching between the acoustic play mode and the silent play mode.

33. The piano of claim 18, wherein the first and second stopper rail members are supported by robust mounting brackets and linkage hardware designed and constructed to resist deflection and/or displacement of associated first and second stopper rails members when struck by one or multiple piano hammers during silent play mode.

34. The piano of claim 18, wherein first and second stopper rail members are supported at inner, opposed ends by an additional robust mounting bracket disposed therebetween, with additional linkage hardware extending between the additional mounting bracket and each of the opposed stopper rail member ends.

35. The piano of claim 18, wherein the stopper rail set varies along its length in manner to cause feel of a piano key strike against a stopper rail in silent play mode to vary along the length of the stopper rail replicating variation in feel of piano key strike against strings of the piano in acoustic play mode along the length of a piano action.

36. The piano of claim 18, wherein at least one of said first and second stopper rail members of said stopper rail set varies along its length in manner to cause feel of a piano key strike against a stopper rail in silent play mode to vary along the length of the stopper rail replicating variation in feel of piano key strike against strings of the piano in acoustic play mode along the length of a piano action.

37. The piano of claim 35 or claim 36, wherein said stopper rail set varies along its length in one or more characteristics selected from among: dimension, shape, mass, stiffness, associated mounting bracket, linkage hardware dimensions, type, thickness, and effectiveness of padding.

38. A hybrid upright piano having selectable silent play mode and acoustic play mode, comprising:

a stopper rail selectably moveable between blocking and non-blocking positions, the stopper rail associated with mounting brackets at opposite ends by stopper rail adjustment screws disposed for rotation in horizontal arrangement relative to the mounting brackets with exposed screw heads fixed axially and rotatable at the mounting bracket, and with a body disposed in threaded engaged with the stopper rail and an associated locknut mounted thereto, wherein rotation of the exposed screw head with a tool disposed horizontally and in general axial alignment with the threaded screw body acts, by threaded engagement of the screw body and stopper rail and locknut, to adjust a horizontal position of the stopper rail relative to an opposed piano string plane for stopping piano key strike against associated piano string during silent play mode.

39. The hybrid upright piano of claim 38, further comprising a travel guide mounted to the piano action and defining a generally horizontal surface disposed to slidably support stopper bar movement between blocking and non-blocking positions.

40. A method for adjusting stopper rail position in a hybrid upright piano having selectable silent play mode and acoustic play mode, comprising the steps of:

selecting silent play mode to place a stopper rail in silent play stopper position;

with one hand, holding a piano hammer against the stopper rail;

using the other hand to turn a screwdriver in engagement with a screw head an axially fixed, rotatable adjustment screw in threaded engagement with the stopper rail and associated locknut mounted thereto;

watching as spacing between the held piano hammer and the piano strings changes while the adjustment screw is turned;

continuing to turn the screwdriver in either direction until desired spacing is achieved; and completing adjustment by discontinuing screw turning.

* * * * *